US007263854B2

(12) United States Patent
Lee et al.

(10) Patent No.: US 7,263,854 B2
(45) Date of Patent: Sep. 4, 2007

(54) ICE SUPPLY SYSTEM

(75) Inventors: Wook Yong Lee, Gyeonggi-do (KR); Myung Ryul Lee, Gyeonggi-do (KR); Seung Hwan Oh, Seoul (KR); Eui Yeop Chung, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/337,585

(22) Filed: Jan. 24, 2006

(65) Prior Publication Data

US 2006/0117786 A1 Jun. 8, 2006

Related U.S. Application Data

(63) Continuation of application No. 10/806,111, filed on Mar. 23, 2004, now Pat. No. 7,017,364.

(30) Foreign Application Priority Data

May 28, 2003 (KR) ..... 2003-34081
Aug. 26, 2003 (KR) ..... 2003-59091
Aug. 26, 2003 (KR) ..... 2003-59113

(51) Int. Cl.
*F25C 1/12* (2006.01)

(52) U.S. Cl. ..... 62/351; 62/353

(58) Field of Classification Search ..... 62/347, 62/351, 353

See application file for complete search history.

(56) References Cited

U.S. PATENT DOCUMENTS 2,744,390 A 5/1956 Partsch
2,869,060 A 1/1959 Chace
2,941,377 A 6/1960 Nelson
3,449,921 A 6/1969 Connors
3,678,701 A 7/1972 Powell et al.
4,614,088 A 9/1986 Brooks
4,838,026 A 6/1989 Searl
4,923,494 A 5/1990 Karlovits
5,261,248 A 11/1993 Willis et al.
5,718,121 A 2/1998 Edwards et al.
5,889,243 A 3/1999 Edwards et al.
6,050,097 A 4/2000 Nelson et al.
6,082,130 A 7/2000 Pastryk
6,148,624 A 11/2000 Bishop et al.
6,286,324 B1 9/2001 Pastryk et al.
6,314,745 B1 11/2001 Janke et al.
6,351,958 B1 3/2002 Pastryk et al.
6,588,227 B2 7/2003 Kim et al.

OTHER PUBLICATIONS

Anonymous, Domestic Ice Maker, Research Disclosure (Nov. 1999) Mason Publications, Hampshire, GB, vol. 427, No. 4, XP007124977.

*Primary Examiner*—William E. Tapolcai
(74) *Attorney, Agent, or Firm*—Birch, Stewart, Kolasch & Birch, LLP

(57) ABSTRACT

An icemaker for an ice supply system for preventing water from overflowing from the ice tray by vibration and/or shaking of the surrounding structure includes an icemaker, a container provided at a lower part of the icemaker and an ice chute for supplying the ice stored in the ice container. An ejector in the ice tray of the icemaker and a dropper device having an inclined upper surface at a side of the open top of the ice tray are provided for dropping the ice discharged upwardly by the ejector. The dropper has no gap or slot through which the ejector passes to prevent water overflow through the dropper. An overflow prevention device is provided at another side of the open top of the ice tray for preventing water filled in the ice tray from overflowing.

20 Claims, 16 Drawing Sheets

ICE SUPPLY SYSTEM

CROSS-REFERENCES TO RELATED APPLICATIONS

This nonprovisional application claims the benefit of Korean Application No. P2003-34081, filed on May 28, 2003; Korean Application No. P2003-59113 filed on Aug. 26, 2003; and Korean Application No. P2003-59091, filed on Aug. 26, 2003; the entirety of each of which are hereby incorporated by reference. This application is a continuation of application Ser. No. 10/806,111 filed on Mar. 23, 2004, now U.S. Pat. No. 7,017,364 the entire contents of which are incorporated by reference and for which priority is claimed under 35 U.S.C. § 120.

BACKGROUND OF THE INVENTION

1. Field of the Invention

The present invention relates to a refrigerator, and more particularly, to an ice supply system for a refrigerator having a structure for preventing water from overflowing from an ice tray by vibration and/or other movement of the surrounding refrigerator structure.

2. Description of the Background Art

The following discussion of the background art is a result of the present inventors analysis of the systems and features of searchlight technology of the background art. A refrigerator is an apparatus that includes a food-storage chamber therein for storing foods for a long-term period in a fresh condition. The food-storage chamber is always maintained at a low temperature by a refrigerating cycle for keeping food fresh. The food-storage chamber is divided into a plurality of storage chambers having different characteristics from each other such that a user can choose a food-storage method in consideration of the type, individual characteristics and/or the expiration dates of the individual foods. A typical storage chamber may include a cooling chamber and a freezer portion.

The cooling chamber keeps a temperature at about 3° C.-4° C. for keeping food and vegetables fresh for a long time. The freezer keeps a temperature at a sub-zero temperature (below 0° C.) for keeping and storing meat and fish frozen for a long time and making and storing ice. The refrigerator has been modified for performing various additional functions besides a typical refrigerating function thereof, e.g., a user had to open a door and take out a water bottle kept in the cooling chamber to drink cold water kept in the cooling chamber hitherto. Accordingly, a refrigerator is often supplied with a water dispenser provided at an outside of the door for supplying cold water cooled by cool air of the cooling chamber and the user can therefore obtain a drink of cold water at the exterior of the refrigerator without having to open the door. Furthermore, a refrigerator incorporating a water purifying function added to the water dispenser is also being supplied.

Further, in a case of using ice for drinking and cooking purposes, the user had to typically open the door of the freezer and take ice out of an ice tray provided in the freezer. However, it is relatively inconvenient for the user to open the door, take out the ice tray and separate ice from the ice tray. In addition, when the door is opened, cool air in the freezer leaks out and the temperature of the freezer goes up. Accordingly, the compressor is forced to work harder and longer to maintain the proper freezer temperature while consuming more energy.

SUMMARY OF THE INVENTION

The present invention overcomes the shortcomings associated with the background art and achieves other advantages not realized by the background art. Specifically, the present invention is directed to an ice supply system that substantially obviates one or more problems due to limitations and disadvantages of the background art.

An object of the present invention is to provide an ice supply system for a refrigerator for supplying ice from an exterior of the refrigerator without having to open a door of the refrigerator.

An object of the present invention is to provide an ice supply system for a refrigerator having an improved structure for preventing water in the icemaker from overflowing to the outside of the icemaker by shaking or other movement of the refrigerator or freezer door.

One or more of these and other objects are accomplished by an ice supply system for a refrigerator having a door, comprising an icemaker being provided within or next to the door of the refrigerator, the icemaker including an ice tray for receiving water; an ejector being provided adjacent to the ice tray; a motor for discharging ice in the ice tray by imparting a rotational motion to the ejector; a dropper having an inclined surface and being provided at an upper part of the ice tray for discharging ice stored within the ice tray via the ejector to the upper part of the ice tray and downward along the inclined surface of the dropper; and a overflow prevention device being provided on a side of the icemaker opposite from the dropper at an upper part of the ice tray for preventing water filled in the ice tray from overflowing out of the ice tray; a container being provided under the icemaker and having an open top and an outlet for discharging the ice; and an ice chute being provided to communicate the dispenser provided at the door with the outlet of the container.

One or more of these and other objects are further accomplished by an icemaker for an ice supply system for a refrigerator, comprising an ice tray for receiving water and making ice; an ejector being provided adjacent to and within the ice tray; a motor for discharging ice in the ice tray by imparting a rotational motion to the ejector; a dropper having an inclined surface and being provided at an upper part of the ice tray for discharging ice stored within the ice tray via the ejector to the upper part of the ice tray and downward along the inclined surface of the dropper; and a overflow prevention device being provided on a side of the icemaker opposite from the dropper at an upper part of the ice tray for preventing water filled in the ice tray from overflowing out of the ice tray.

The icemaker includes an ice tray for receiving water, an ejector, a dropper and an overflow prevention device. In this case, the ejector is provided adjacent to the ice tray and rotated by a motor for discharging the ice in the ice tray. The dropper is provided at an upper part of the ice tray and has an inclined surface for dropping the ice to a lower part thereof, wherein the ice is discharged to the top of the ice tray via the ejector. The overflow prevention device is provided at an upper outside portion of the ice tray for preventing water filled in the ice tray from overflowing. The icemaker as aforementioned is provided at or within the door of the refrigerator.

The container includes an opened top and an outlet discharging the ice and provided at a lower part of the icemaker. The ice chute communicates the dispenser provided at the door with the outlet. The overflow prevention device includes a panel extending from the upper outside of the ice tray for a predetermined distance. In this case, the panel can be installed to the ice tray or separated from the ice tray. However, the panel and the ice tray are formed as a single body.

In the present invention, the panel includes a concave surface facing an inside of the ice tray. In this case, it is desirable that the ice tray is formed in a semi-cylindrical shape, and the curved surface of the panel and the inner surface of the ice tray have the same curvature. It is desirable that a range of an angle between a lower end of the panel and an upper end of the panel is 30° to 60° when a central axis of the ice tray is at an angular point or apex.

In the present invention, the panel can be longitudinally provided contrary to an above description. In this case, a height of the panel is 0.7 to 1.5 times of a radius of the ice tray. The dropper is provided to cover space between the upper part of the ice tray and a central axis of the ejector for preventing water from overflowing. The dropper is provided to the ice tray or separated from the ice tray. The dropper and the ice tray are formed as a single body.

In the present invention, a side of the dropper adjacent to the central axis of the ejector includes an inclined surface or a convex surface for easily transferring the ice to a top surface of the dropper, wherein the ice is discharged upwardly from the ice tray. The dropper includes at least one groove provided on the upper surface of a top plate for leading the ice discharged to the upper part of the ice tray and dropped to the top surface of the top plate.

The dropper includes the top plate having an inclined top surface inclined to a side, thus a side of the top plate adjacent to the central axis of the ejector is higher than an opposite side thereof, and a rim extending downward from both sides of the top plate and an opposite side of the side adjacent to the central axis of the ejector for surrounding an upper outside of the ice tray.

In the present invention, the dropper, in more detail includes the top plate provided at a location offset from the central axis of the ice tray to a top portion thereof for a predetermined distance. The dropper is provided at a location offset from the central axis of the ice tray to a top portion thereof for a predetermined distance. The ice tray is formed in a semi-cylindrical shape and the central axis of the ejector is provided along the central axis of the ice tray. In this case, it is desirable that the offset distance between the dropper and the ice tray is less than 0.2 times of a radius of the ice tray.

The icemaker further includes a sensor provided at an end of the dropper for sensing a rotation angle of the ejector when the sensor is in contact with a rotating ejector. In this case, the ejector rotates in a first direction until being in contact with the sensor from a first location and inversely rotates in an opposite direction of the first direction until it reaches the first location after contacting the sensor.

In the present invention, the dropper includes at least one slot through which a part of the ejector passes when the ejector rotates. In this case, the ejector keeps rotating in the first direction. Meanwhile, the overflow prevention device in the present invention includes a cover coupled with a hinge at the upper part of the ice tray for covering an open top of the ice tray.

In the present invention, the cover covers the top of the ice tray by its own weight and opens the top of the ice tray by being pushed upward via the ejector. In this case, a spring coupled with the top of the cover is provided at the top of the cover for pushing the cover in a direction such that the cover covers the top of the ice tray and the cover can cover the top surface of the dropper.

The cover can be opened and closed by force of the motor. For this, a second gear assembly is further provided for rotating the hinge axis of the cover such that the cover or the ice tray is opened or closed according to the rotation of the ejector in the present invention. The ejector is directly coupled with the motor or via the first gear assembly. For example, the first gear assembly includes the first gear coupled with the motor and the second gear engaged with the first gear and coupled with the ejector.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

DETAILED DESCRIPTION OF THE PREFERRED EMBODIMENTS

Figure 1:
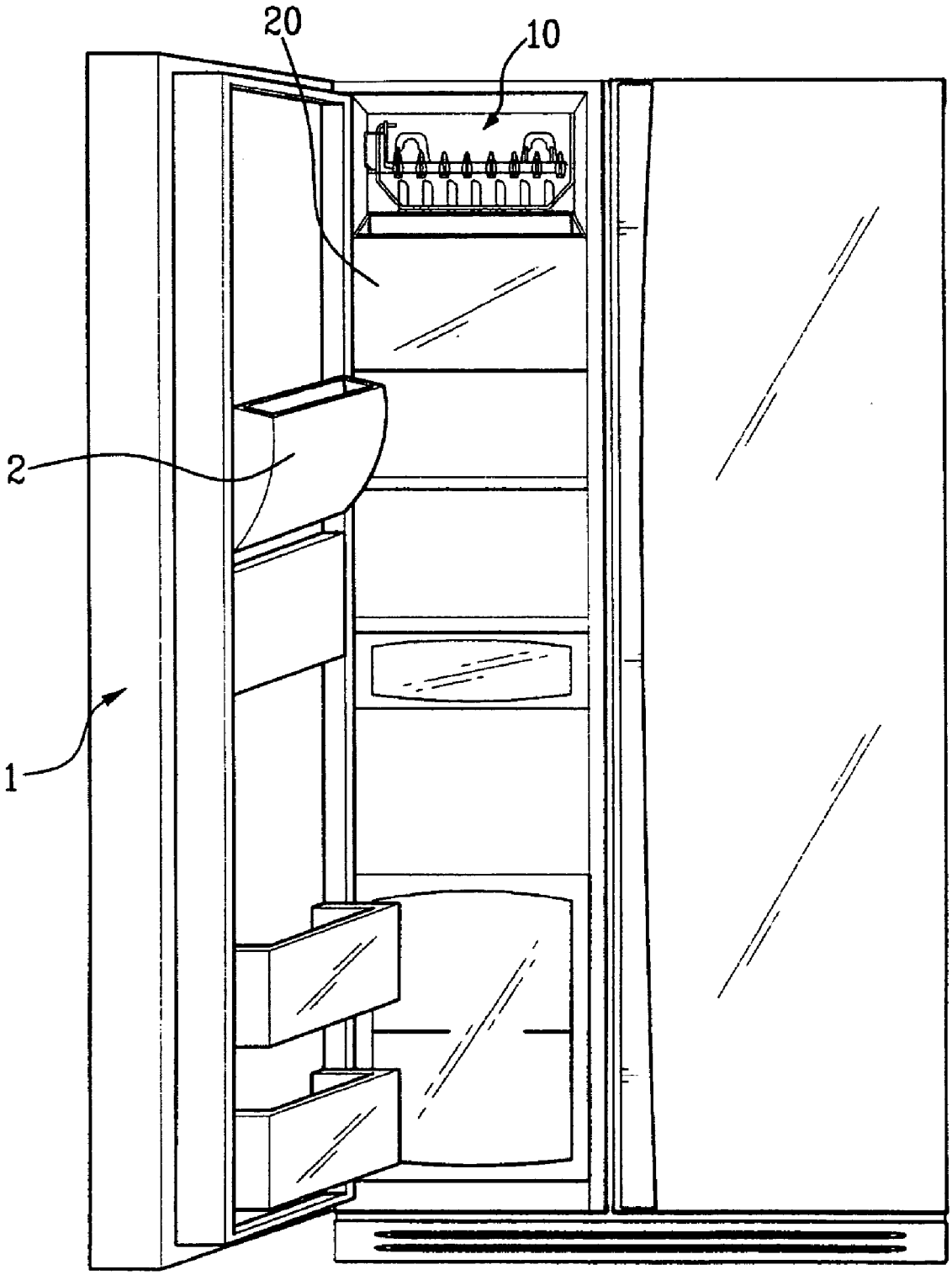
FIG. 1 is a perspective view of an interior of a refrigerator with an ice supply system according to an embodiment of the present invention.
Figure 2:
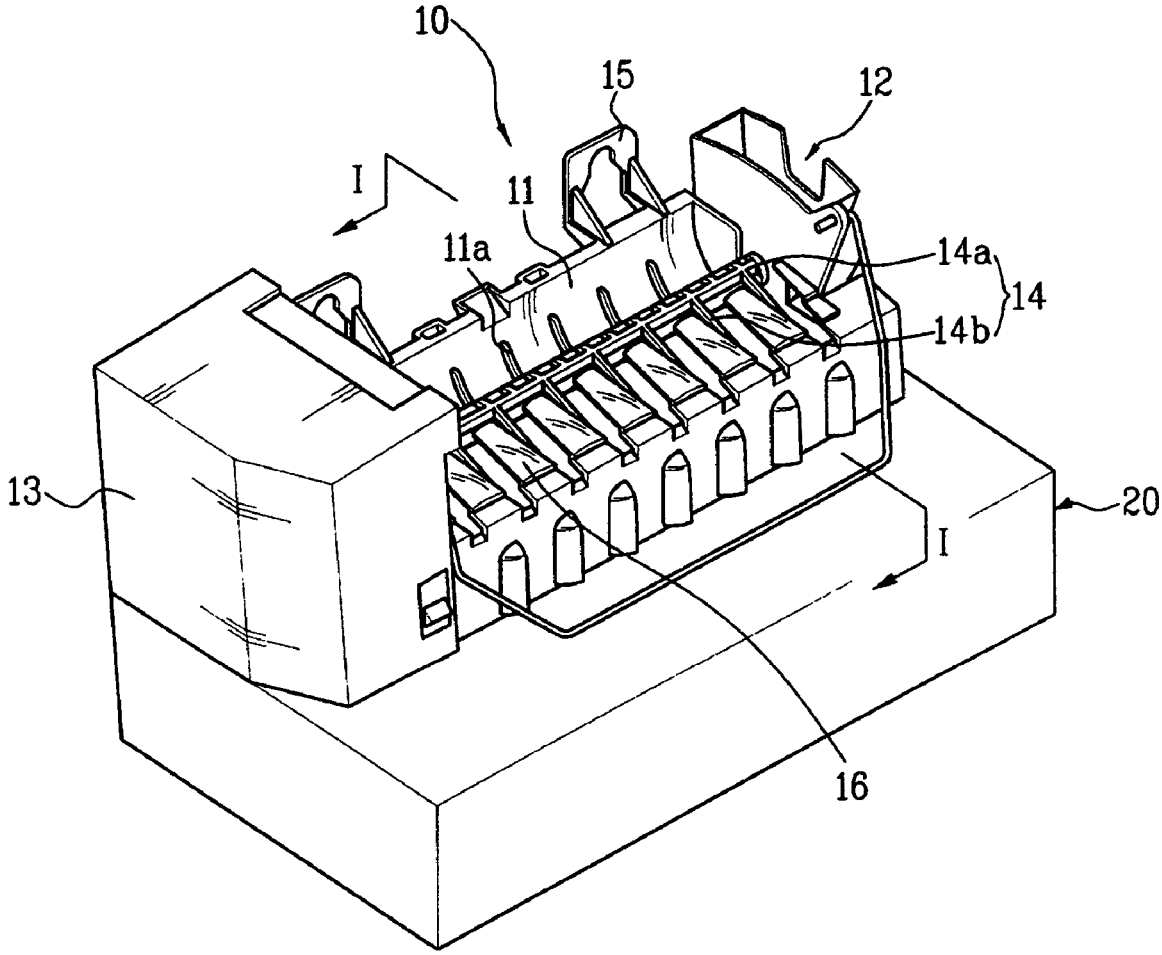
FIG. 2 is a perspective view of an icemaker and an ice container according to an embodiment of the present invention.
Figure 3:
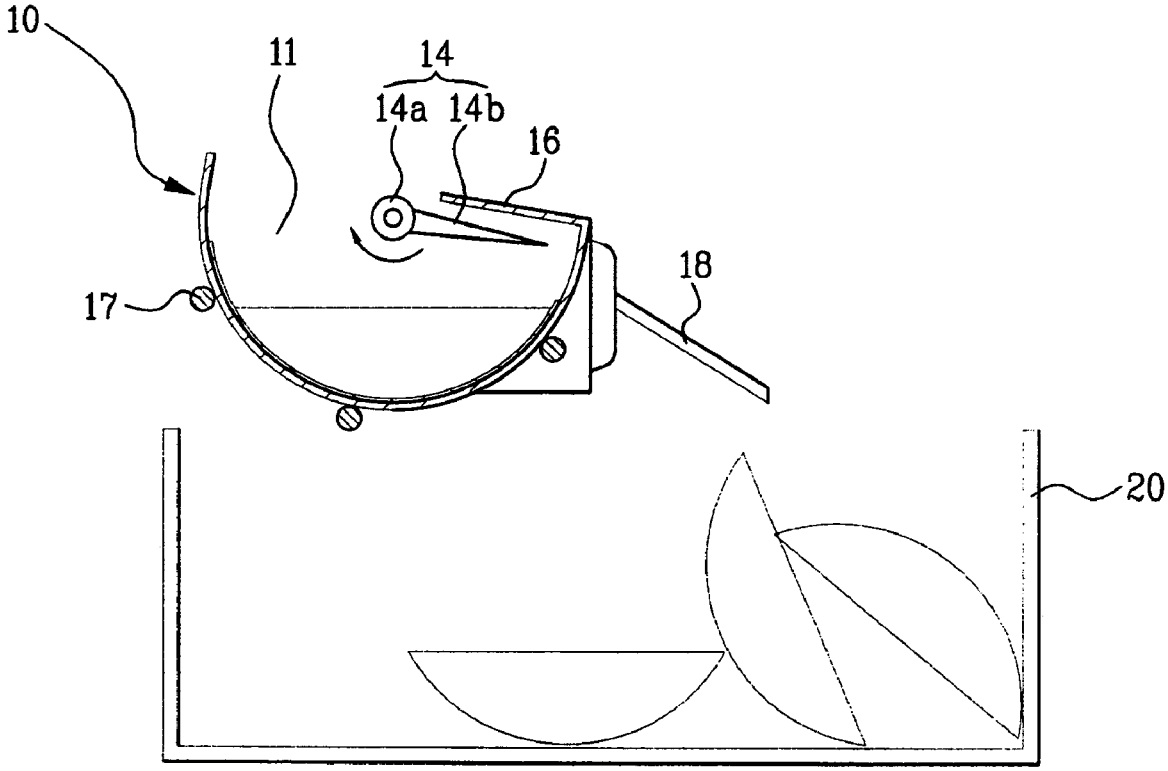
FIG. 3 is a sectional view taken along the line I-I of FIG. 2.
Figure 4:
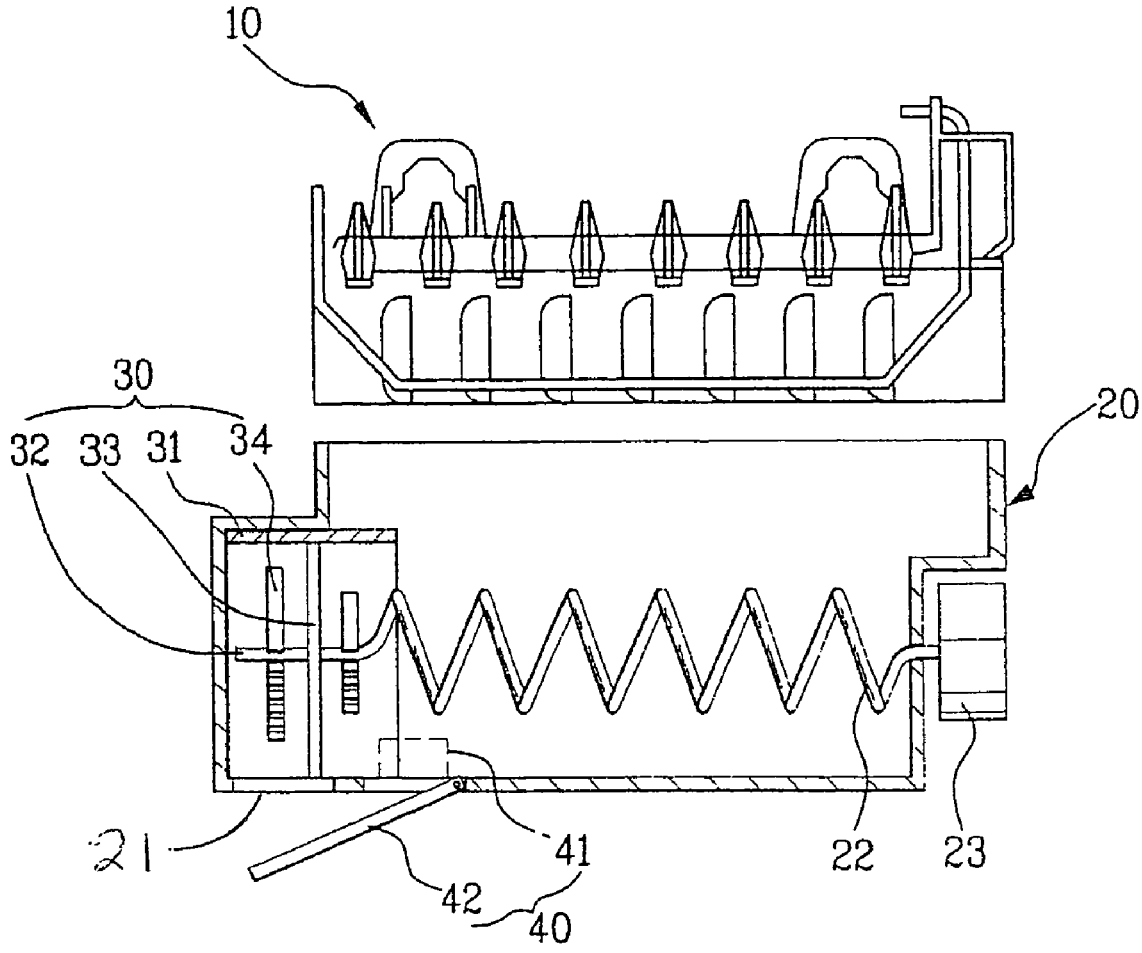
FIG. 4 is a partial, sectional view of an interior of a refrigerator with an ice supply system in an improved structure according to an embodiment of the present invention.

The present invention will hereinafter be described with reference to the accompanying drawings. FIG. 1 is a perspective view of an interior of a refrigerator with an ice supply system according to an embodiment of the present invention. FIG. 2 is a perspective view of an icemaker and an ice container according to an embodiment of the present invention. FIG. 3 is a sectional view taken along the line I-I of FIG. 2. FIG. 4 is a partial, sectional view of an interior of a refrigerator with an ice supply system in an improved structure according to an embodiment of the present invention.

In FIG. 1, a refrigerator is shown having an ice supply system according to an embodiment of the present invention. The refrigerator includes a cooling chamber and a freezer, and a door 1 is provided in front of the refrigerator for opening and closing the cooling chamber and the freezer. An ice supply system is provided at the door 1 and the freezer according to the present invention. Hereinafter, referring to FIG. 1 to FIG. 4, a structure of the ice supply system is described in detail according to the present invention.

Referring to FIG. 1, the ice supply system according to the present invention includes an icemaker 10 for producing ice, a container 20 for storing the ice produced from the icemaker 10, an ice chute 2 for supplying the ice stored in the container 20 to a dispenser (not illustrated) provided at the door 1. The icemaker 10 is provided in the cooling chamber of the refrigerator as illustrated in FIG. 1 and includes an ice tray 11, a water supplier 12, an ejector 14 and a motor 13.

The ice tray 11 has an open top as illustrated in FIG. 2 and the interior of the ice tray is formed in a semi-cylindrical form for storing water and ice. A plurality of ribs 11*a* are provided in the ice tray 11 for dividing the interior space into a plurality of sections. The plurality of ribs 11*a* protrude from the inner surface of the ice tray 11 as illustrated in FIG. 2. The ribs 11*a* help the ice tray 11 produce a plurality of small pieces of ice.

The water supplier 12 is provided at a side of the ice tray 11 as illustrated in FIG. 2 for supplying water to the ice tray 11. A bracket 15 is provided to secure the icemaker 10 to the freezer as illustrated in FIG. 2. The ejector 14 includes a shaft 14*a* and a plurality of fins 14*b*. The shaft 14*a* as a central axis of the ejector 14 is placed to cross the center along the longitudinal direction at an upper inside of the ice tray 11. The plurality of fins 14*b* are extended in a radial direction on an outer circumferential surface of the shaft 14*a*. It is desirable that the plurality of fins 14*b* are provided at a common interval along the longitudinal direction of the shaft 14*a*. Particularly, each of the plurality of fins is placed in each section provided in the ice tray 11 by the ribs 11*a*.

The motor 13 is provided at a point of an outer circumferential surface of the ice tray 11 to be pivotably connected to the shaft. Accordingly, when the shaft 14*a* is rotated via the motor 13, the plurality of fins 14*b* are rotated together. Each of the plurality of fins 14*b* pushes the ice in the ice tray 11 and drops to a lower part of the icemaker 10. Referring to FIG. 2 and FIG. 3, a plurality of droppers are provided in front of the ice tray 11, i.e., at an upper end of an opposite side of a side where the bracket is provided.

Each of the droppers 16 is extended from a front upper part of the ice tray 11 to a point near the shaft 14*a*. In this case, a small gap exists between each of the droppers 16 and the plurality of fins 14*b* pass through the gap when the shaft 14*a* rotates. The ice in the ice tray 11 is pushed by the plurality of fins 14*b*, separated from the ice tray 11 and dropped on the droppers 16 after being completely separated. The ice dropped on the droppers 16 are dropped again to the lower part of the icemaker 10 to be stored in the container 20 provided at the lower part of the icemaker 10. Accordingly, an upper surface of the dropper 16 extends to drop the ice separated from the ice tray 11 to the lower part of the dropper. Therefore, it is desirable that a side of the dropper 16 adjacent to the shaft 14*a* slopes toward one side and thus the side of the dropper 16 near the shaft 14*a* is arranged at a higher position than a front side of the ice tray 11.

The present inventors have determined that a structure is needed for preventing ice separated from the ice tray 11 from dropping to a rear side of the ice tray 11. For this, it is desirable that a rear end of the ice tray 11 is provided higher than the shaft 14*a* as shown in FIG. 3 according to an embodiment of the present invention. Then, ice separated from the ice tray 11 is moved to the rear side of the ice tray 11 by the plurality of fins 14*b*, is smoothly lead to the front side of the ice tray 11 and is then dropped to the upper surface of the dropper 16.

A heater 17 is provided at a lower surface of the ice tray 11 as illustrated in FIG. 4. The heater 17 heats a surface of the ice tray 11 for a short time and slightly melts the ice on the surface of the ice tray 11. Accordingly, ice is easily separated when the shaft 14*a* and the plurality of fins 14*b* rotate. Referring to FIG. 3 and FIG. 4, a sensing arm 18 is provided in the icemaker 10 for estimating an amount of ice stored in the container 20. The sensing arm 18 estimates the amount of ice stored in the container 20 by being controlled by a controller (not illustrated) and moving up and down. For example, the sensing arm 18 periodically descends, e.g., a descending amount of the sensing arm 18 is relatively large when a small amount of ice is stored in the container 20. On the other hand, the sensing arm 18 bumps into the ice sooner and the corresponding descending amount is smaller when a large amount of ice is stored in the container 20. Accordingly, the controller estimates the amount of ice in the ice container 20 by sensing the descending amount of the sensing arm 18.

The container 20 is also provided at the lower part of the icemaker 10 as illustrated in FIG. 1 to FIG. 3 and has an open top for receiving and storing the ice dropped from the icemaker 10. On a surface, i.e., a floor of the container 20, an outlet 21 is provided for discharging the ice to the lower part as illustrated in FIG. 4. According to the present invention, a transferring device 22 is provided in the container 20 for transferring the ice stored in the container 20 to a side where the outlet 21 is provided. The transferring device 22, for example, is formed in a zigzag or spiral shaped form and is provided to extend across an inside of the container 20. The transferring device 22 is connected to the motor 23 and transfers the ice stored in the container 20 to the side where the outlet 21 is provided.

A structure for crushing ice can also be provided in the present invention. A crusher 30 is provided at a side of the outlet 21 in the container 20 as illustrated in FIG. 4. The crusher 30 includes a housing 31, a shaft 32, a supporter 33 and a blade 34. The housing 31 is provided on the outlet 21 in the container 20 and a surface, i.e., a side corresponding to the transferring device 22 is formed in an opened form. The supporter 33 is provided to support the shaft 32 in the housing 31 as illustrated in FIG. 4. The shaft 32 is provided to pass through the supporter 33 and is rotated together with the housing 31 at a predetermined place.

The blade 34 is coupled with the shaft 32 and crushes the ice transferred by the transferring device 22 rotating with the shaft 32. At least one or more blades 34 are provided, and it is desirable that the blades 34 are provided at both sides around the supporter 33 when a plurality of the blades 34 are provided. The outlet 21 provided in the container is automatically opened or closed according to a user's choice. For this, an ice discharger 40 is provided at the outlet 21. The ice discharger 40 includes an actuator 41 and a shutter 42 as illustrated in FIG. 4. The shutter 42 is formed as a plate to be able to open the outlet 21. The actuator 41 is connected to the shutter 42 by a lever (not illustrated). In this case, for example, a solenoid type actuator is employed as the actuator 41. In the ice discharger 40 as described above, the actuator 41 is operated according to a control signal of the controller and the shutter 42 controls an amount of the opening and closing of the outlet 21 moving in accordance with the actuator 41.

The ice chute 2 is provided at the bottom of and next to the container, i.e., at a lower part of the outlet 21 as illustrated in FIG. 1. The ice chute 2 is provided to pass through the door 1 and the ice discharged from the outlet 21 is lead to the outside of the door 1. Although it is not illustrated, an ice dispenser is provided at an end of the ice chute 2. The ice dispenser connects with the ice chute from the outside of the door 1 and supplies a predetermined amount of ice to a user when the user wants to use the ice.

An operation of the ice supply system of the refrigerator will be described according to the present invention as mentioned above. First, when the controller (not illustrated) determines that the amount of ice in the container 20 is not enough by an operation of the sensing arm 18, water is supplied to the water supplier 12 of the icemaker 10. The water supplied to the water supplier 12 is filled in the spaces between the ribs 11*a* of the ice tray 11 and frozen by the cold air of the freezer. A plurality of pieces of ice in a regular, uniform size are produced via the ribs 11*a* in the ice tray 11. When a predetermined time period passes and the ice is produced, the heater 17 is operated for a short period of time to loosen the ice within the ice tray 11. Accordingly, an exterior of the ice tray 11 is slightly heated and each piece of ice separates from the ice tray 11 as the exterior of each piece of ice is slightly melted.

The motor 13 starts to operate and the shaft 14*a* and the plurality of fins 14*b* are then rotated together. The plurality of fins 14*b* push the ice between the ribs 11*a* in a circumferential direction of the ice tray 11 and the ice is completely separated from the ice tray 11 via the plurality of fins 14*b*, is dropped onto the dropper 16 and is subsequently dropped to the lower part of the icemaker 10. The ice dropped to the lower part of the icemaker 10 is stored in the container 20.

When a predetermined amount of the ice is filled in the container 20 from an above repeated process, the sensing arm 18 detects the amount of the ice and the controller stops producing ice. Of course, when it is determined via the sensing arm 18 that the ice is not enough, the process is repeated to continue producing the ice and the produced ice is stored in the container 20.

Meanwhile, a user manipulates the control panel provided on an outer surface of the door 10 in a state that the container 20 is filled with the ice, the user is supplied with crushed ice or uncrushed ice in a large size through the ice dispenser. Hereinafter, the process will be described.

When the user manipulates the control panel to select a function for supplying the ice, the motor 23 rotates and transfers a large piece of ice stored in the container 20 to the crusher 30. The large piece of ice transferred to the crusher 30 is crushed into smaller pieces of ice. Meanwhile, when the crushed ice is supplied through the ice dispenser, the shutter 42 slightly opens the outlet 21. The outlet 21 is provided at the lower part of the crusher 30 and the crushed ice is discharged through the outlet 21. The crushed ice passes through the ice chute 2 and supplied to the user through the ice dispenser.

When the user manipulates the control panel to select a function for supplying a large piece of uncrushed ice, the shutter 42 completely opens the outlet 21. When the motor 23 operates and the transferring device 22 rotates, the large pieces of ice stored in the container 20 are transferred to the crusher 30. At this time, the large pieces of uncrushed ice are discharged through the outlet 21 before reaching the crusher 30, pass through the ice chute 2 and are supplied to the user through the ice dispenser.

Using the refrigerator with the ice supply system according to the present invention as mentioned above, the user is selectively supplied with crushed ice and uncrushed ice. However, the present inventors have determined that the ice supply system has a few disadvantages described in greater detail hereinafter with reference to FIG. 4.

According to an embodiment described in reference to FIG. 1 to FIG. 4, the icemaker 10 and the container 20 are provided at the cooling chamber in the refrigerator. Therefore, there is a problem that a space of the refrigerator is not effectively used such that the icemaker 10 and the container 20 take up a lot of space thereof. In order to overcome this problem, the icemaker 10 and the container 20 may be provided in or at the door 1. However, in this case, a second problem can occur. Specifically, if water is supplied to the ice tray 11 of the icemaker 10 for producing ice when the door 1 is simultaneously opened, the water in the ice tray 11 is often heavily shaken by inertia and the swinging moment of the door 1. Accordingly, water can overflow when the door 1 is opened and closed. Therefore, the present inventors have created an ice supply system with an improved structure for preventing water from overflowing when the door is opened or closed as aforementioned. An improved structure for an ice maker of the present invention will be described in greater detail hereinafter.

Figure 5:
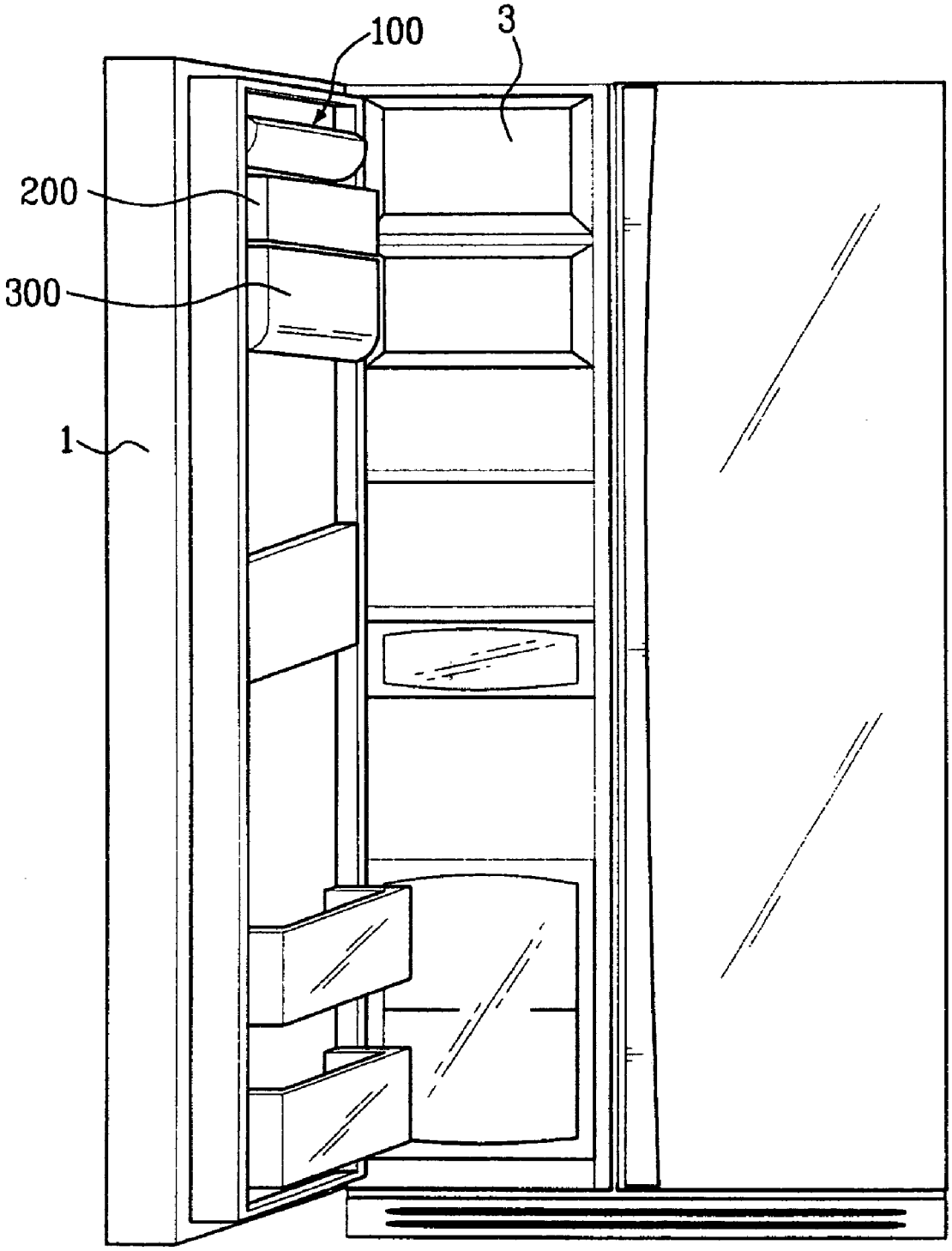
FIG. 5 is a perspective view of an inside of a refrigerator with an ice supply system in an improved structure according to an embodiment of the present invention.

Referring to FIG. 5, the ice supply system with the improved structure according to the present invention includes an icemaker 100, a container provided at a lower part of the icemaker 100 and installed at the door 1 and an ice chute 300 for communicating the container 200 with the dispenser (not illustrated) and supplying ice stored in the container 20 to the dispenser. The ice supply system with an improved structure is provided at the door 1 and has an advantage of utilizing the space in the cooling chamber of the refrigerator.

In order to user the icemaker installed at the door 1 as mentioned above, water stored in the icemaker 100 needs to be prevented from overflowing by a swinging action of the door 1. The ice supply system with an improved structure according to the present invention includes an overflow prevention device and a dropper with an improved structure for preventing water from overflowing. The overflow prevention device and the dropper are provided at an upper part of the ice tray in positions facing each other for preventing water from overflowing to an outside of the ice tray when the door 1 is opened or closed and water is shaken. The structure of the icemaker 100 will be described in greater detail hereinafter with reference to the drawings.

As a reference, for convenience in describing, a side of the dropper is hereinafter named as a front side of the ice tray and a side of the overflow prevention device is named as a rear side of the ice tray. When each embodiment is described, same name and number as those in the embodiment described referring to FIG. 1 to FIG. 4 are employed. And, description of the same structure as the embodiment described referring to FIG. 1 to FIG. 4 will be omitted and only the structure for preventing water from overflowing will be described.

Figure 6:
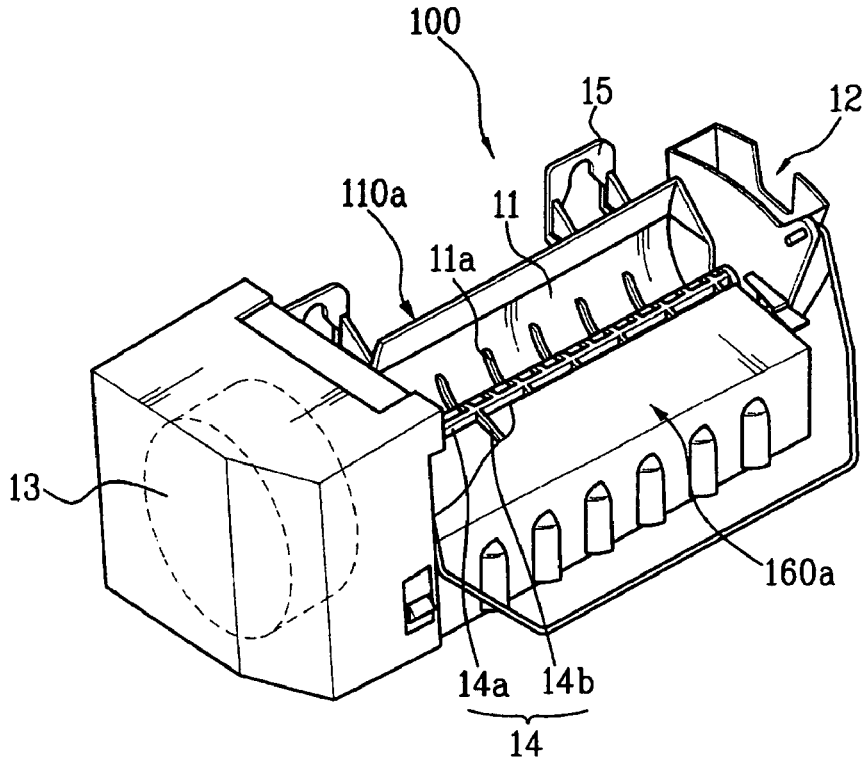
FIG. 6 is a perspective view of a first embodiment of an icemaker in the ice supply system of FIG. 5.
Figure 7:
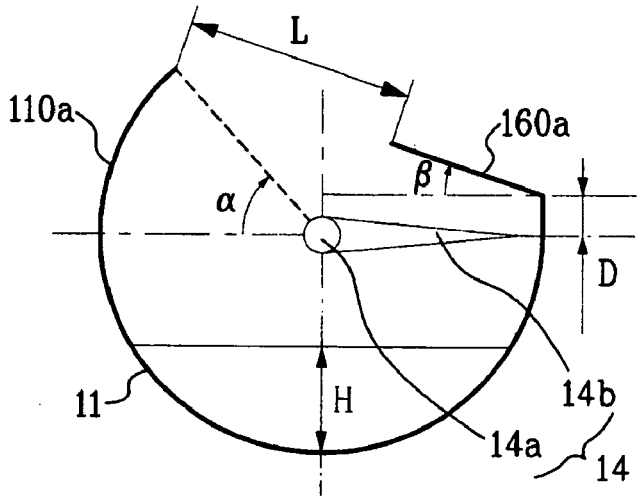
FIG. 7 is a sectional view of the icemaker shown in FIG. 6.
Figure 8:
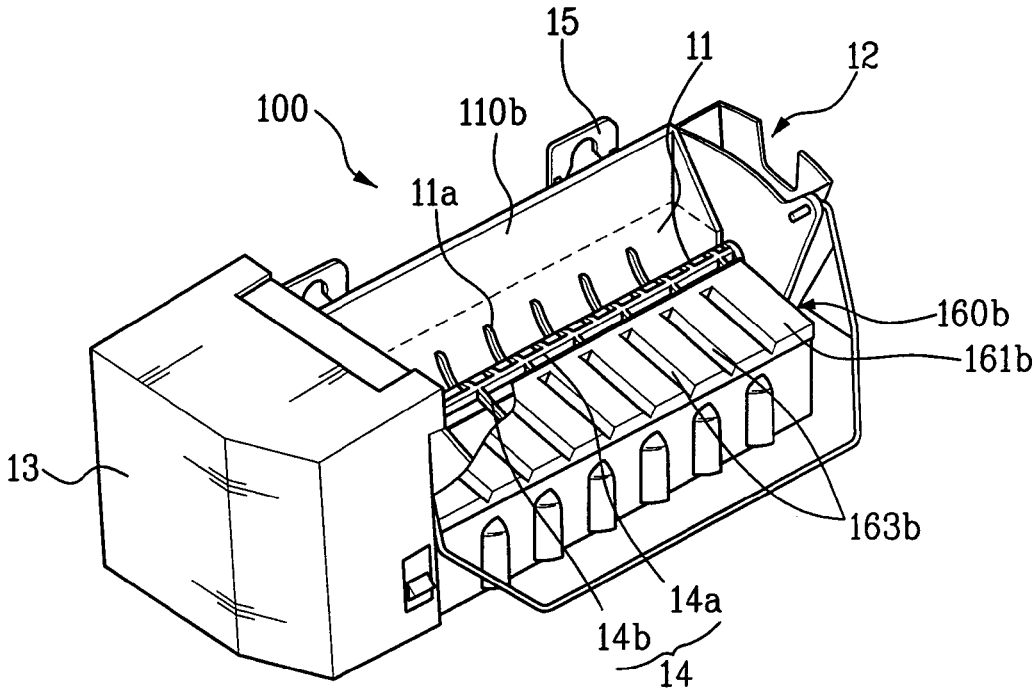
FIG. 8 is a perspective view of a second embodiment of an icemaker in the ice supply system of FIG. 5.
Figure 9:
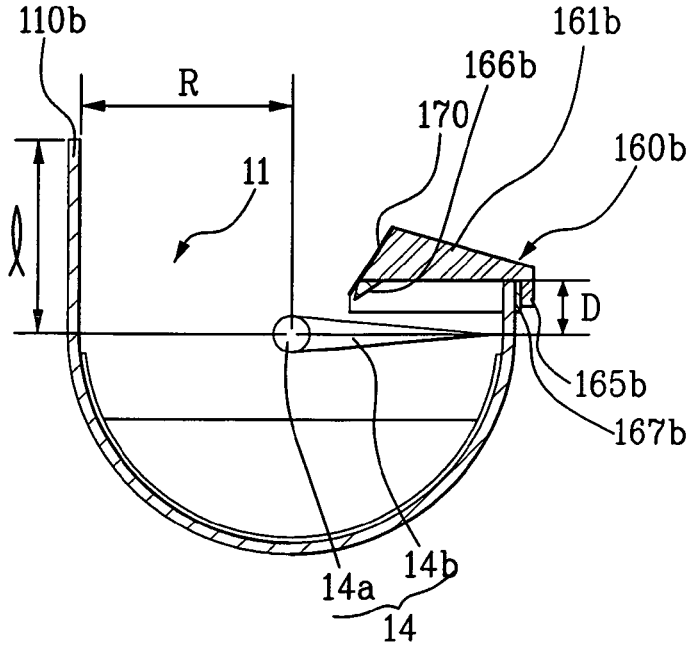
FIG. 9 is a sectional view of the icemaker shown in FIG. 8.
Figure 10A:
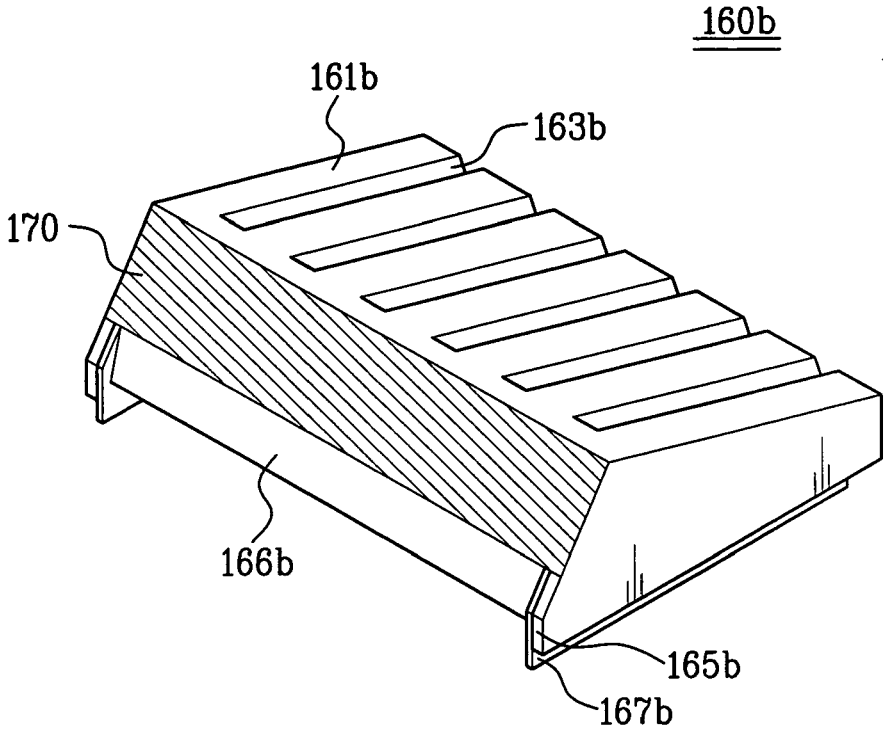
FIG. 10A is perspective view of a dropper in the icemaker of FIG. 8 as viewed from above the dropper.
Figure 10B:
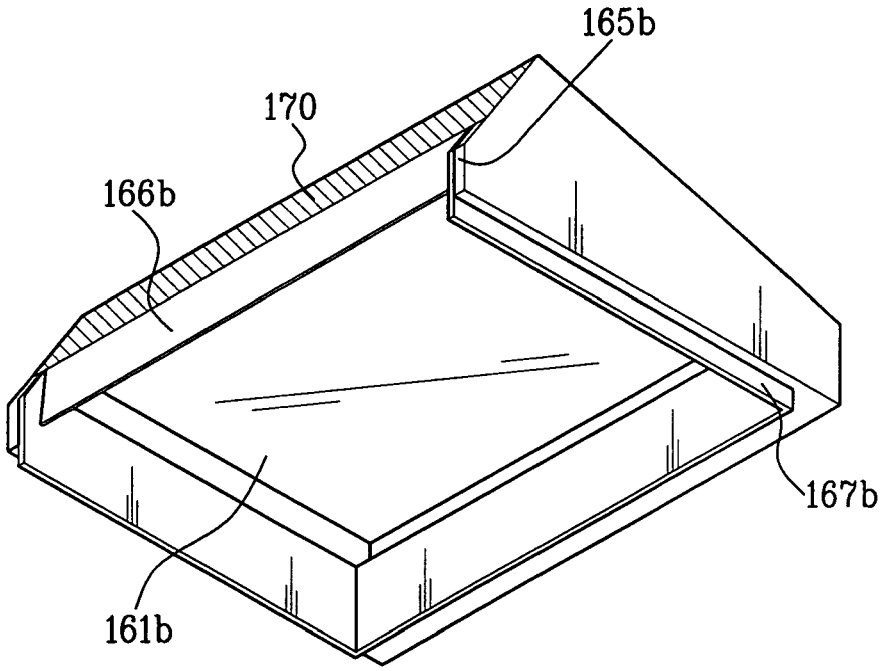
FIG. 10B is a perspective view of a dropper in the icemaker of FIG. 8 as viewed from below the dropper.
Figure 10C:
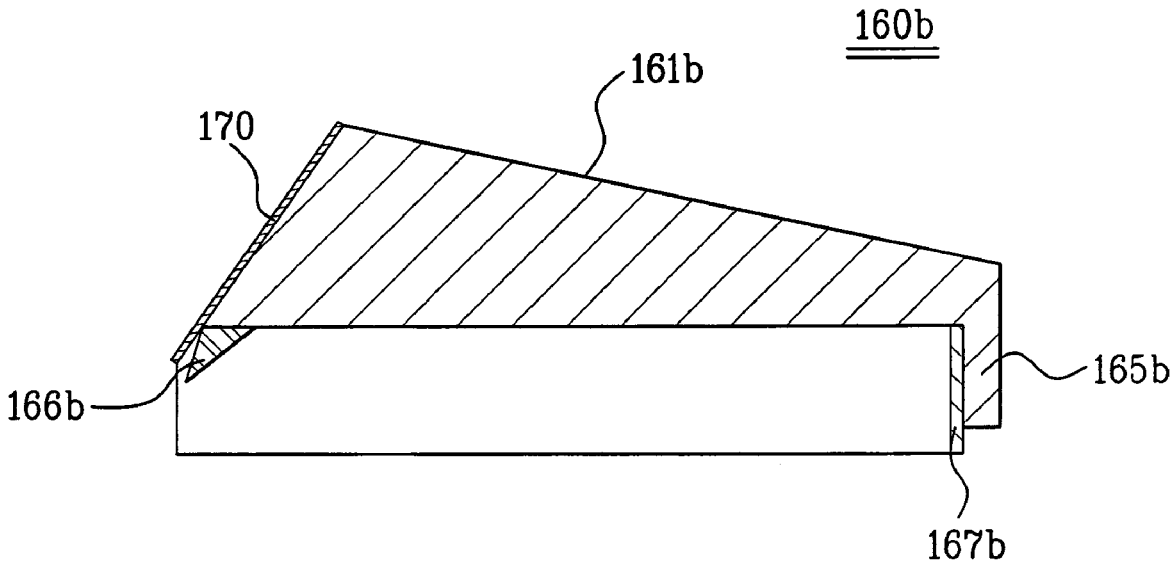
FIG. 10C is a sectional view of the dropper in the icemaker of FIG. 8.

FIG. 5 is a perspective view of an inside of a refrigerator with an ice supply system in an improved structure according to an embodiment of the present invention. FIG. 6 is a perspective view of a first embodiment of an icemaker in the ice supply system of FIG. 5. FIG. 7 is a sectional view of the icemaker shown in FIG. 6. FIG. 8 is a perspective view of a second embodiment of an icemaker in the ice supply system of FIG. 5. FIG. 9 is a sectional view of the icemaker shown in FIG. 8. FIG. 10A is perspective view of a dropper in the icemaker of FIG. 8 as viewed from above the dropper. FIG. 10B is a perspective view of a dropper in the icemaker of FIG. 8 as viewed from below the dropper. FIG. 10C is a sectional view of the dropper in the icemaker of FIG. 8.

FIG. 6 is a perspective view illustrating a first embodiment of the icemaker in the ice supply system of FIG. 5 and FIG. 7 is a cross-sectional view of the icemaker of FIG. 6. Referring to FIG. 6, a dropper 160*a* in the icemaker 100 according to the first embodiment is slightly different from the example described in reference to FIG. 2. The overflow prevention device includes a panel 110*a* provided at an upper part of the icemaker at an opposite side of the dropper 160*a*. Therefore, the panel 110*a* and the dropper 160*a* in the icemaker 100 according to the first embodiment prevent water in the ice tray 11 from overflowing by a shaking action thereof.

Referring to FIGS. 6 and 7, the panel 110*a* is extended upward from an upper rear side of the ice tray 11 for a predetermined length. In this case, a side of the panel 110*a* facing an inside of the ice tray 11 includes a concave face. When the panel 110*a* has a concave face, water slopping in the ice tray 11 from an inner side to the panel 110*a* is naturally lead to the inner side thereof. When the ice in the ice tray 11 is discharged to an upper part of the ice tray 11 via an ejector 14, the ice is lead to an upper surface of the dropper 160*a*.

Referring to FIG. 6 and FIG. 7, the ice tray 11 is formed in a semi-cylindrical shape having an open top. Accordingly, it is desirable that a curved surface of the panel 110*a* and the inside of the ice tray 11 include the same curvature in the first embodiment. In this case, water slopping in the ice tray 11 from an inner side to the panel 110*a* is naturally lead to the inner side thereof along the inside of the ice tray 11 and the curved surface of the panel 110*a*. When the ejector 14 discharges the ice, the ice is easily transformed along the inside of the ice tray 11 and the curved surface of the panel 110*a*.

Meanwhile, the panel 110*a* includes a length for preventing water from overflowing from the ice tray 11. However, when the curved surface of the panel 110*a* and the inside of the ice tray 11 have the same curvature, a cross section of the panel 110*a* includes an arc form as illustrated in FIG. 7 and it is easy to describe the length of the panel 110*a* by an angle α. Since the radius of the ice tray 11 is already determined and thus the length of the ice tray 11 is calculated when a central axis of the ice tray 11 is at an angular apex and an angle between a lower end and an upper end of the panel 110*a* is determined. A range of the angle α between the lower end and the upper end of the panel 110*a* is proposed to be between 30° to 60°. This is a value obtained from a plurality of experiments. As a reference, FIG. 7 illustrates a case on the assumption that the shat 14*a* of the ejector 14 is provided on the central axis of the ice tray 11.

The panel 110*a* and the ice tray 11 can be formed as a single body or separately. When the panel 110*a* and the ice tray 11 are formed as a single body, there is a difficulty in forming the panel 110*a* and the ice tray 11 as a single body using a metallic pattern. On the other hand, when the panel 110*a* is formed as a separate body, it is easy to form the panel 110*a* and the ice tray 11 separately using a metallic pattern. There is an advantage that the panel 110*a* can be attached to the ice tray in the embodiment described referring to FIG. 1 to FIG. 4. In this case, it is economical in that a manufacturer can use a part of the ice tray even if the structure of the refrigerator is changed. Furthermore, when the bracket is provided at the freezer 3 and the door 1, the user can selectively install the icemaker 100 at either the door 1 or the freezer 3 according the user's preference.

Meanwhile, the dropper 160*a* covers the space between the front upper part of the ice tray 11 and the shaft 14*a* for preventing water from overflowing as illustrated in FIG. 7 in the first embodiment. The dropper 160*a* and the ice tray 11 are formed as a single body. When the dropper 160*a* and the ice tray 11 are formed as a single body, the dropper 160*a* is provided at the ice tray 11.

Referring to FIG. 7, the dropper 160*a* is provided separate from a centerline of the shaft 14*a* for a predetermined distance. FIG. 7 illustrates an embodiment showing that the shaft 14*a* is provided at the central axis of the ice tray 11. Accordingly, the dropper 160*a* is provided at a location being offset from the central axis of the ice tray 11.

Also, referring to FIG. 7, a side of the dropper 160*a*, e.g., the side adjacent to the shaft, is inclined higher than the front side of the ice tray 11. The ice discharged via the ejector 14 is easily slipped along the front surface of the dropper 160*a* and dropped to the container 200. A lower surface of the dropper 160*a* easily leads water slopping in the ice tray 11 to the inside of the ice tray 11. Meanwhile, it is desirable that an angle of inclination of the dropper ranges from 10° to 45°.

The ice in the ice tray 11 rises along the inside of the ice tray 11 and the curved surface of the panel 110*a* being pushed by the plurality of fins 14*b* of the ejector 14 and is discharged to the open top of the ice tray 11. The ice is discharged through a space between the upper end of the panel 110*a* and an end of the dropper 160*a* as illustrated in FIG. 7. Therefore, it is desirable that a length between the upper end of the panel 110*a* and the end of the dropper 160*a* is formed to be larger in size than a maximum height of the ice frozen in the ice tray 11. In the embodiment described above, in a case that the dropper 160*a* includes a slot (not illustrated) through which the fin 14*b* passes during the rotation of the shaft 14*a*, water may flow out of the ice tray 11 through the slot when the door 1 is heavily shaken. However, the dropper 160*a* may not include the slot as illustrated in FIG. 6. In this case, the plurality of fins 14*b* may not pass through the dropper 160*a* and thus the shaft

14*a* should be able to rotate in a first direction and in a second direction. In other words, when a motor is provided for rotating in the first direction and in the second direction, the plurality of fins 14*b* rotates from a first place to a position of the dropper 160*a* to discharge the ice and inversely rotates to the first place after discharging the ice to return to an initial operating position shown approximately in FIG. 7.

A second embodiment of the icemaker in the ice supply system is illustrated in FIG. 8 to FIG. 10*c*. Referring to FIG. 8 and FIG. 9, a panel 110*b* and a dropper 160*b* are provided to prevent water in the ice tray from overflowing by a shake according to the second embodiment. The provided location of the panel 110*b* and the dropper 160*b* is the same as the first embodiment described in reference to FIG. 6 and FIG. 7 and a repeated description will be omitted with reference to FIG. 8. The structure of the panel 110*b* and the dropper 160*b* provided in the second embodiment will be described in greater detail hereinafter.

Referring to FIG. 8 and FIG. 9, the panel 110*b* is provided at a position perpendicular to the upper rear part of the ice tray 11 in contrast to the panel 110*a* of the first embodiment. The panel 110*b* provided above should include enough height or clearance to prevent water slopping in the ice tray 11 from overflowing to the rear side of the ice tray 11. It is not necessary for the panel 110*b* to be very high, e.g., so high as to sacrifice the available space for the installation and manufacturing efficiency of the ice tray 11. Accordingly, it is preferable that an appropriate height of the panel 110*b* is about 0.7 to 1.5 times of the radius of the ice tray 11 according to a preferred embodiment of the present invention.

When the panel is provided perpendicular to the upper part of the ice tray 11, water in the ice tray 11 is prevented from overflowing to the rear side of the ice tray 11. The ice tray 11 and the panel 110*b* are easily formed as a single body by using the metallic pattern such that it is difficult to separate a form with a complex curved surface from the metallic pattern and easy to separate a form with a simple straight line. The panel 110*b* and the ice tray 11 are formed as a single body. However, it is acceptable and possible to separately manufacture the panel 110*b* to be able to attach to and detach from the ice tray 11.

The dropper 160*b* according to the second embodiment is provided to cover the upper part of the ice tray 11 and the space near the shaft 14*a*. The dropper 160*b* includes a top plate 161*b* and a rim 165*b*. The top plate 161*b* includes a top surface inclined to one side and a side of the top plate adjacent to the shaft 14*a* is higher than an opposite side thereof as illustrated in FIG. 9 to FIG. 10. In this case, it is desirable that a range of an angle of the top surface is 10° to 45°. The top surface of the top plate 161*b* leads to slide the ice discharged through the upper part of the ice tray 11 via the ejector 14 to the lower part thereof.

Meanwhile, FIG. 9 illustrates another embodiment of the top plate 161*b* having a different thickness. However, in the present invention, the top plate can be designed to have a same thickness. In this case, the top surface and the bottom surface of the top plate 161*b* are inclined such that the side adjacent to the shaft 14*a* is higher than the opposite side thereof. Accordingly, the water slopping in the ice tray 11 from side to side is naturally lead to an inside of the ice tray 11 along the bottom surface of the top plate 161*b*.

All the ice dropped to the upper surface of the dropper 160*b* should be dropped to the inside of the container 200 other than to another place. For this, on the top surface of the top plate 161*b*, at least one groove 163*b* is provided as illustrated in FIG. 8 and FIG. 10A. It is desirable that the at least one groove 163*b* is formed at an opposite side of the side adjacent to the shaft 14*a* and a plurality of the grooves are formed at a predetermined interval.

The top plate 161*b* includes a bottom surface parallel to the horizon or the bottom surface inclined by a predetermined angle. When the bottom surface of the top plate 161*b* is inclined, the range of the angle is from −10° to 10°. This means that a side of the bottom surface adjacent to the shaft 14*a* is lower than the opposite side thereof or the side adjacent to the shaft 14*a* is higher than the opposite side thereof.

The rim 165*b* is extended to both sides of the top plate 161*b* from the opposite side of the side adjacent to the shaft 14*a* to the lower part thereof as illustrated in FIG. 10A and 10B. When the dropper 160*b* is provided at the ice tray 11, the rim 165*b* is described above as surrounding an upper outer surface of the ice tray 11. Meanwhile, a side adjacent to the shaft among a plurality of sides of the dropper 160*b* is inclined as illustrated in FIG. 9 to FIG. 10B so as to easily transfer the ice to the top surface of the dropper 160*b* along the side adjacent to the shaft 14*a*, e.g., the ice being pushed by the ejector 14 and discharged to the upper part of the ice tray 11. In FIG. 9 to FIG. 10B, an example showing the side adjacent to the shaft 14*a* slopes. However, it is okay the side is formed as the curved surface is slightly convex.

Referring to FIG. 10A to FIG. 10C, the dropper 160*b* further includes a shield 166*b*. The shield 166*b* extends downward from an end side adjacent to the shaft 14*a* of the dropper. The shield as composed as aforementioned prevents water slopping in the ice tray 11 from being bumped into the lower surface of the dropper 160*b* and moving to the shaft 14*a* and leads the water to the inside of the ice tray 11. The shield 166*b* as aforementioned includes a predetermined angle of inclination against a perpendicular line. As a reference, FIG. 9 illustrates an example showing that the shield 166*b* is inclined toward one side.

The dropper 160*b* as aforementioned and the ice tray 11 is formed as a single body or formed separately. In this case, the bottom of the ice tray is concave and a side of the open top of the ice tray 11 is covered. Accordingly, it is difficult to form the ice tray 11, the panel 110*b* and the dropper 160*b* as a single body using the metallic pattern. Therefore, the dropper 160*b* is formed separately from the ice tray 11 and is installed to the ice tray.

Meanwhile, a pad 167*b* is further included with the dropper 160*b*. The pad 167*b* is formed of rubber materials or synthetic resins and provided along the inner circumferential surface of the rim 165*b* for improving adhesion of the rim 165*b* and the ice tray 11. When the dropper 160*b* and the ice tray 11 are separately manufactured, and provided to the ice tray 11 and the pad 167*b* is provided, the pad 167*b* improves adherence of the dropper 160*b* and the ice tray 11 and prevents water from leaking between the rim 165*b* and the ice tray 11. Meanwhile, if a sealing material such as silicon is adhered to the pad 167*b*, adherence and waterproofing are further improved.

In the icemaker 100 according to the second embodiment having a structure as aforementioned, it is desirable that the slot is not provided at the dropper 160*b*, the slot through which the fin 14*b* passes when the ejector 14 rotates so as to prevent water from being leaked through the slot. With respect to the slot for the fin 14*b* to pass through at the dropper 160*b*, a structure is required for preventing the fin 14*b* and the dropper 160*b* from interfering with each other.

In the second embodiment of the present invention, it is desirable that the motor is included for rotating the shaft 14*a* in a first direction and a second direction. An additional structure for controlling a rotational range of the shaft 14*a* by estimating a rotation angle of the shaft 14*a* connected to the motor 13.

Accordingly, in the icemaker 100 according to the second embodiment of the present invention, a sensor 170 is further included for sensing a rotation angle of the shaft 14*a*. The sensor 170 is provided at an adjacent surface of the shaft 14*a* among a plurality of surfaces of the dropper 160 as illustrated in FIG. 9 and senses the rotation angle of the shaft 14*a* when the fin 14*b* is in contact with the sensor 170.

If the sensor 170 is provided, a control section discharges the ice by using a method of inversely rotating the motor 13 till the fin 14*b* reaches the first place when the fin 14*b* rotates clockwise at a first place illustrated in FIG. 9 and is in contact with the sensor 170. Accordingly, water is effectively prevented from leaking even though the slot is not provided in the dropper 160*b*.

The icemaker according to the present invention further includes a sensor 170 provided at an end of the dropper for sensing the rotation angle of the shaft 14*a* when the fin 14*b* rotating together with the shaft 14*a* is in contact. In the present invention, the motor 13 is rotatably provided enabling rotation in both directions, e.g., clockwise and counterclockwise. In this case, the fin 14*b* is rotated in the first direction from the first place until it contacts the sensor 170 and in the second direction until it reaches the first place after contacting the sensor 170.

A predetermined distance D may be provided between the dropper 160*b* and the upper surface of the ice tray 11. Specifically, a lower end of the dropper 160*b*, i.e., a lower end of the top plate 161*b* is separately provided from the longitudinal line passing the shaft 14*a* as illustrated in FIG. 9 such that the fin 14*b* is not in contact with the dropper 160*b* when the fin 14*b* rotates.

The dropper 160*b* can also be provided at a place offset from the central axis of the ice tray 11 for a predetermined distance. In this case, it is desirable that the ice tray 11 is formed in a semi-cylindrical shape and the shaft 14*a* is provided along the central axis of the ice tray 11. It is desirable that the separated distance between the dropper 160*b* and the upper part of the ice tray 11 or the off-set distance is less than 0.2 times of the radius of the ice tray 11.

Figure 11:
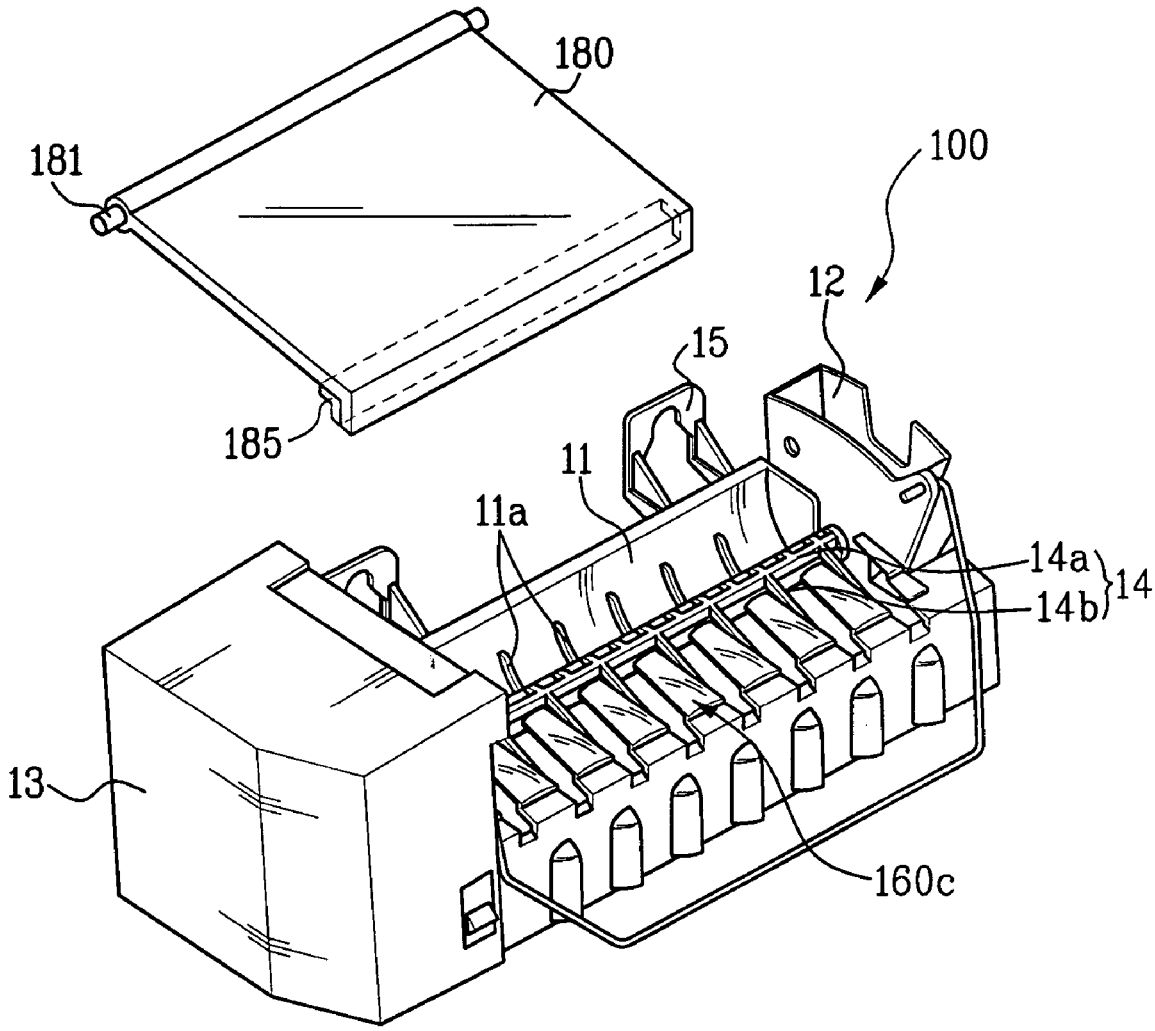
FIG. 11 is an exploded, perspective view of a third embodiment of an icemaker in the ice supply system of FIG. 5.
Figure 12A:
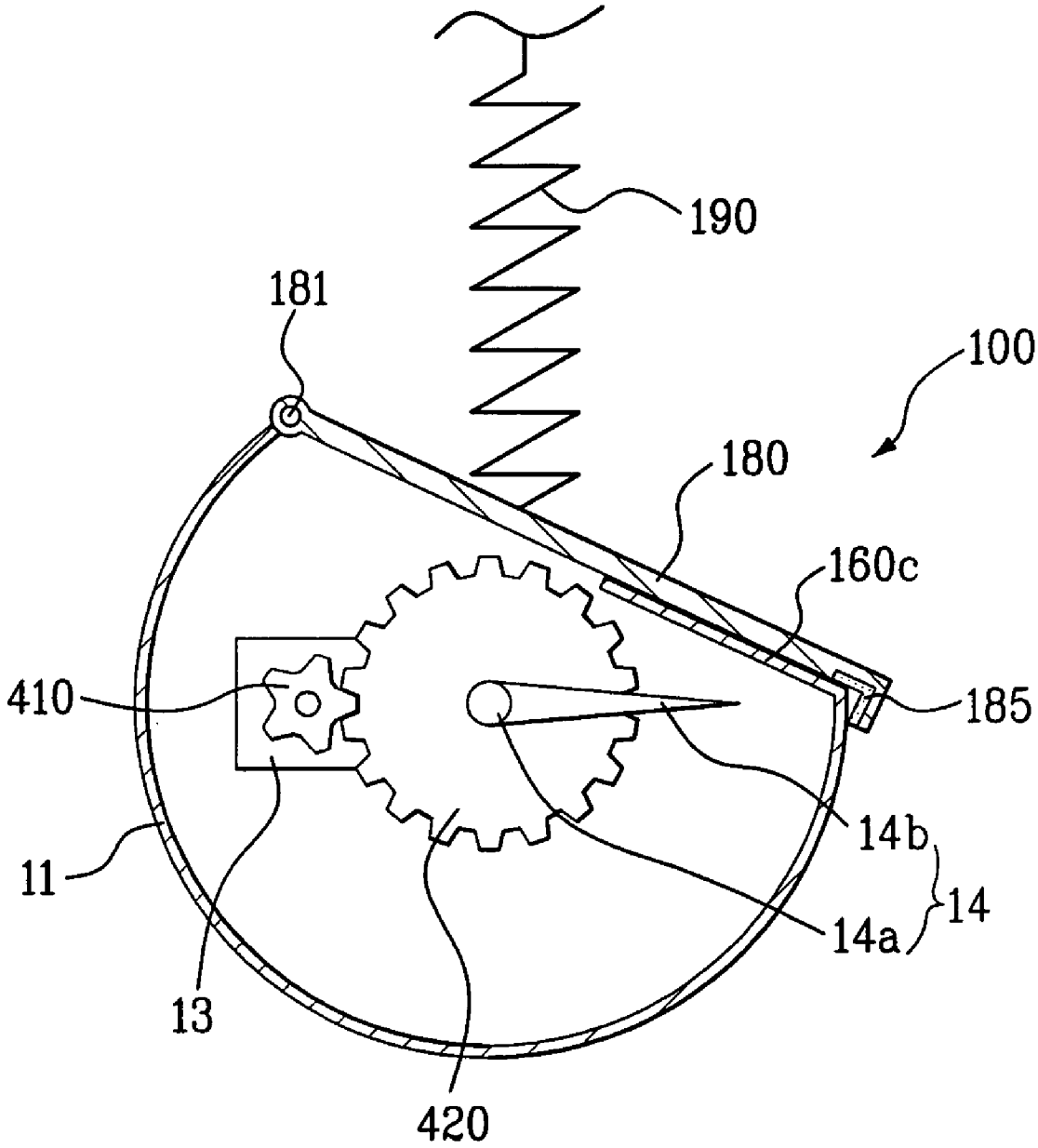
FIG. 12A is a cross-sectional view of an exemplary spring provided in the icemaker of FIG. 11 shown in a state in which a cover is in a closed position.
Figure 12B:
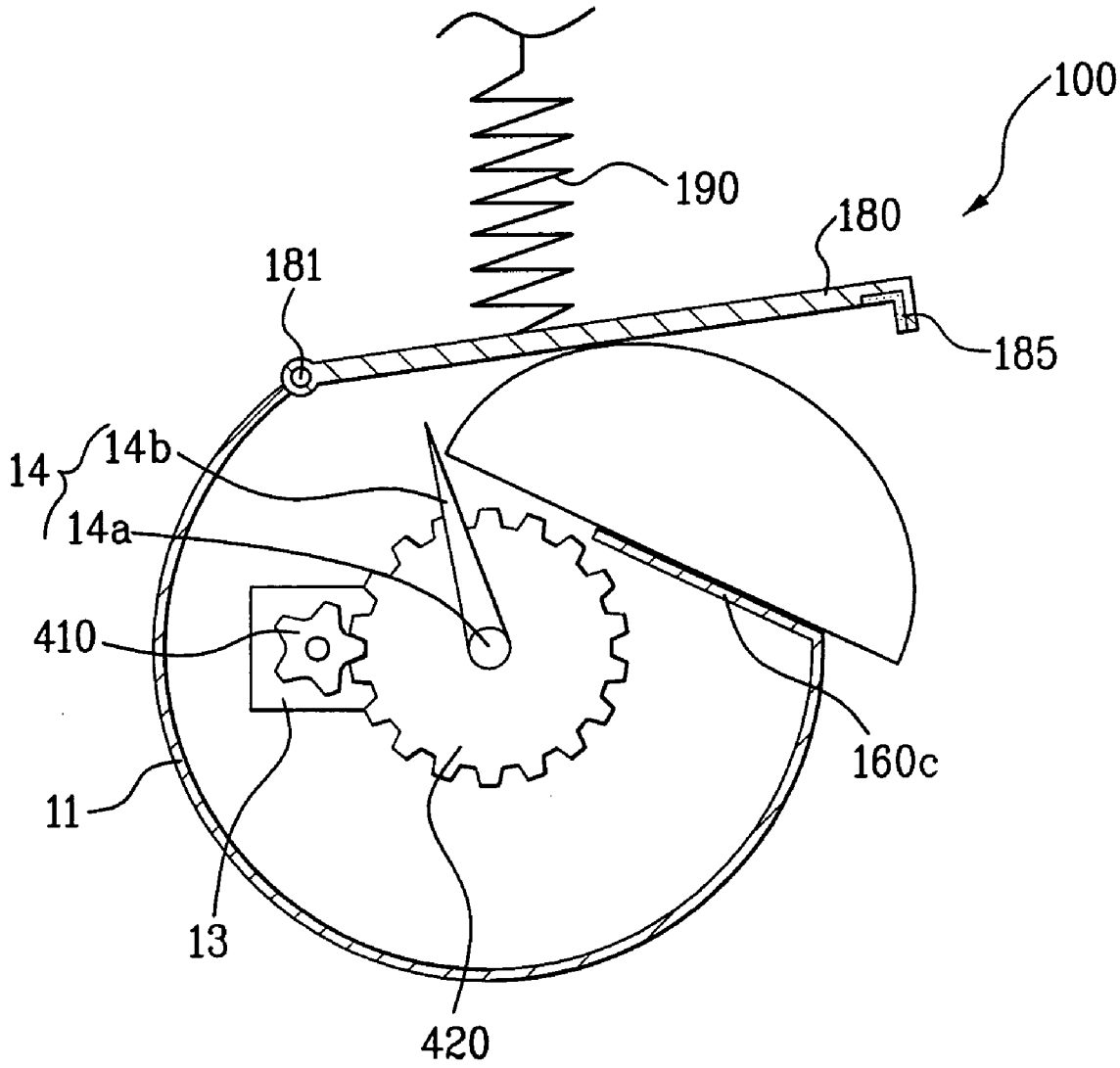
FIG. 12B is cross-sectional view of an exemplary spring provided in the icemaker of FIG. 11 shown in a state in which a cover is in an opened position.
Figure 13A:
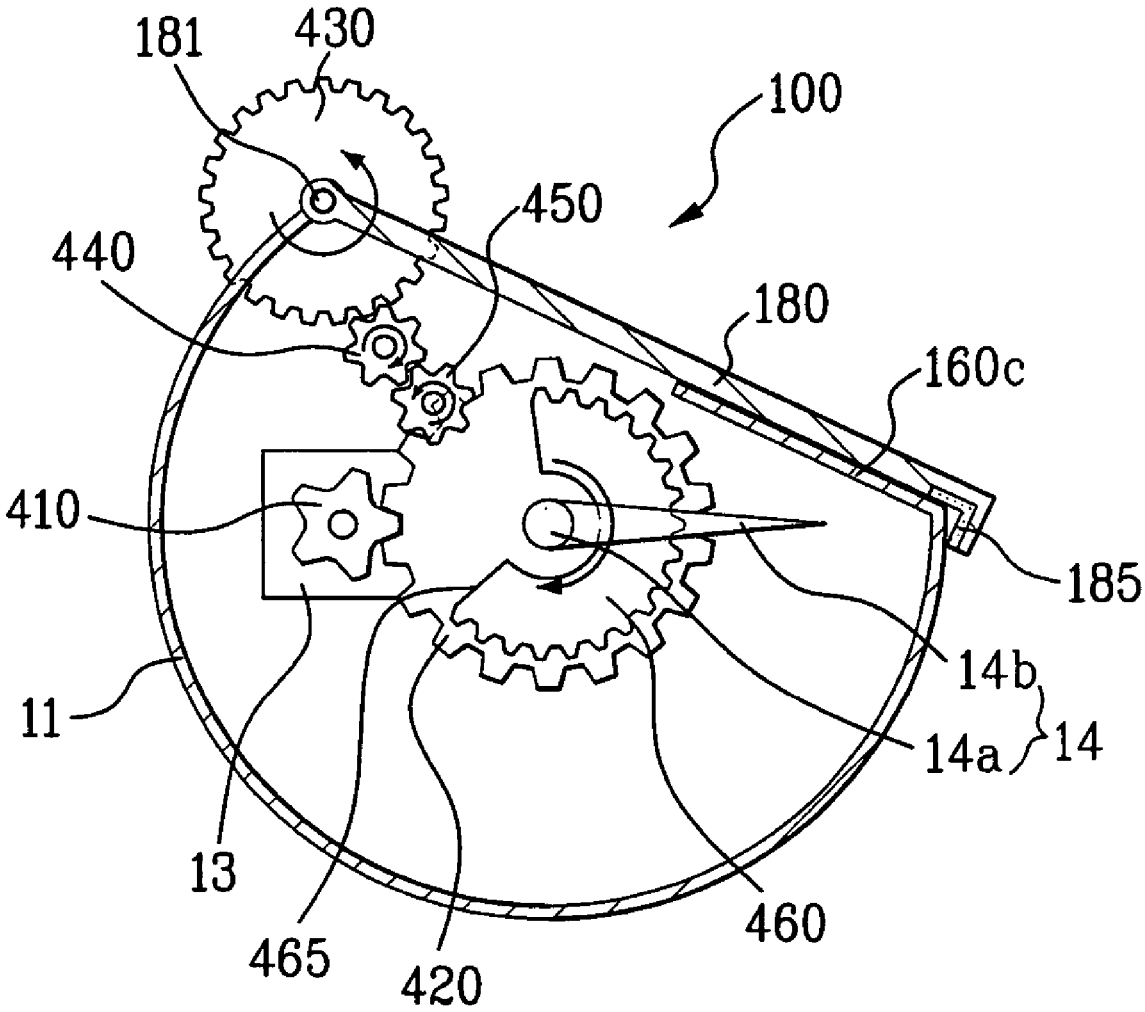
FIG. 13A is a cross-sectional view of an exemplary gear assembly provided for rotating a cover of the icemaker of FIG. 11 in a state in which a cover is in a closed position.
Figure 13B:
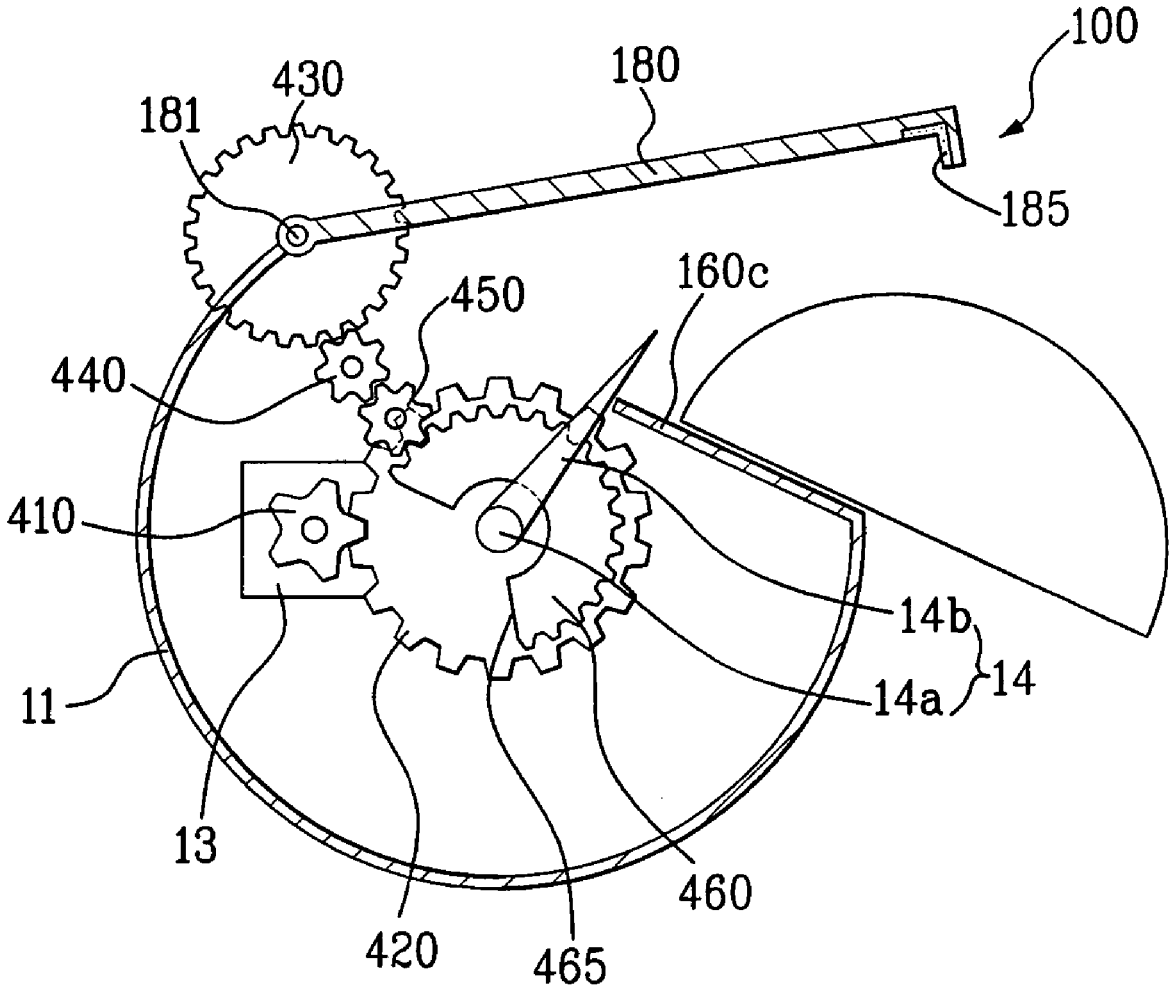
FIG. 13B is a cross-sectional view of an exemplary gear assembly provided for rotating a cover of the icemaker of FIG. 11 in a state in which a cover is in an open position.
Figure 14A:
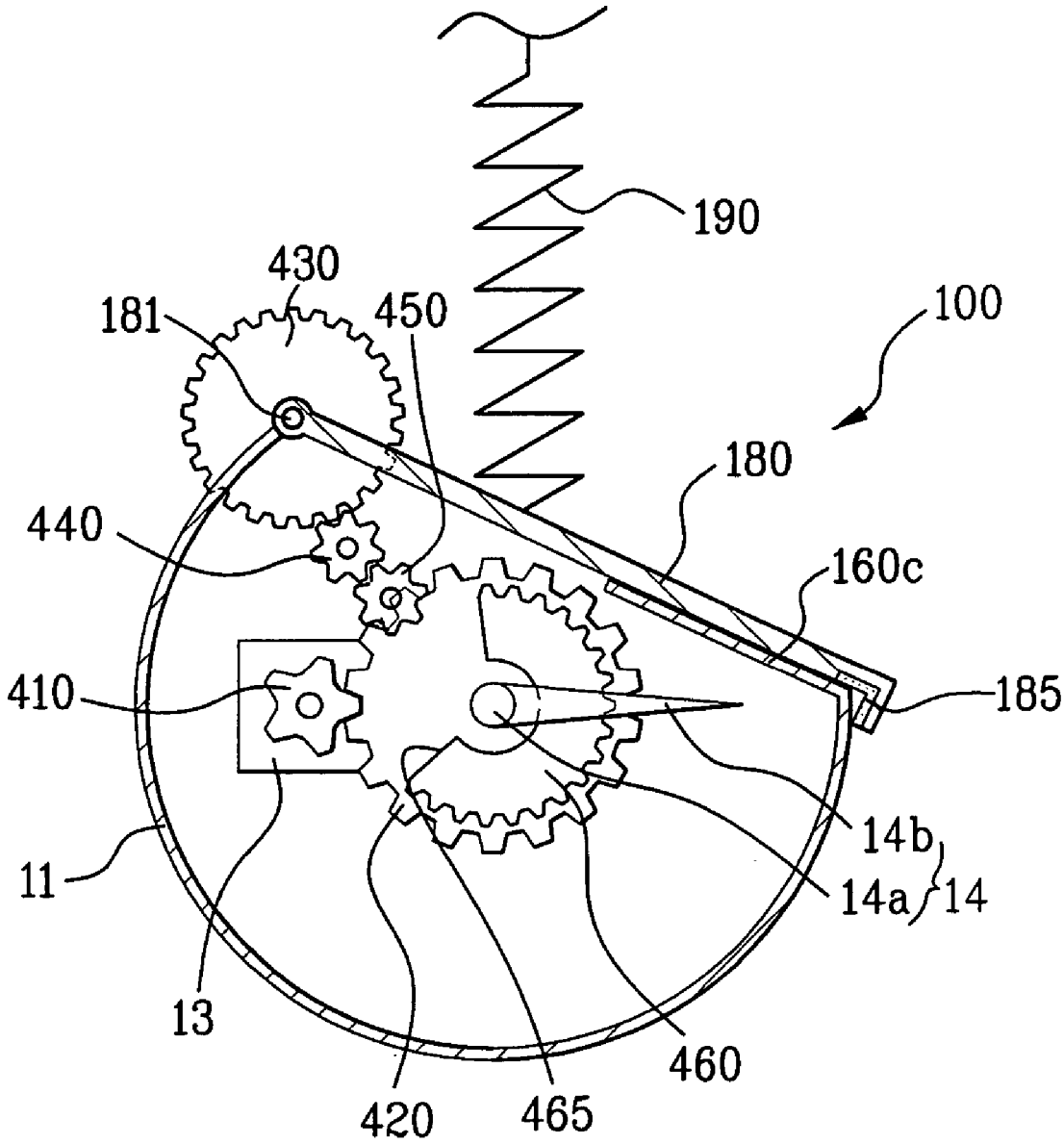
FIG. 14A is a cross-sectional view of an exemplary gear assembly and a spring provided for rotating a cover of the icemaker of FIG. 11 shown in state in which the cover is in a closed position.
Figure 14B:
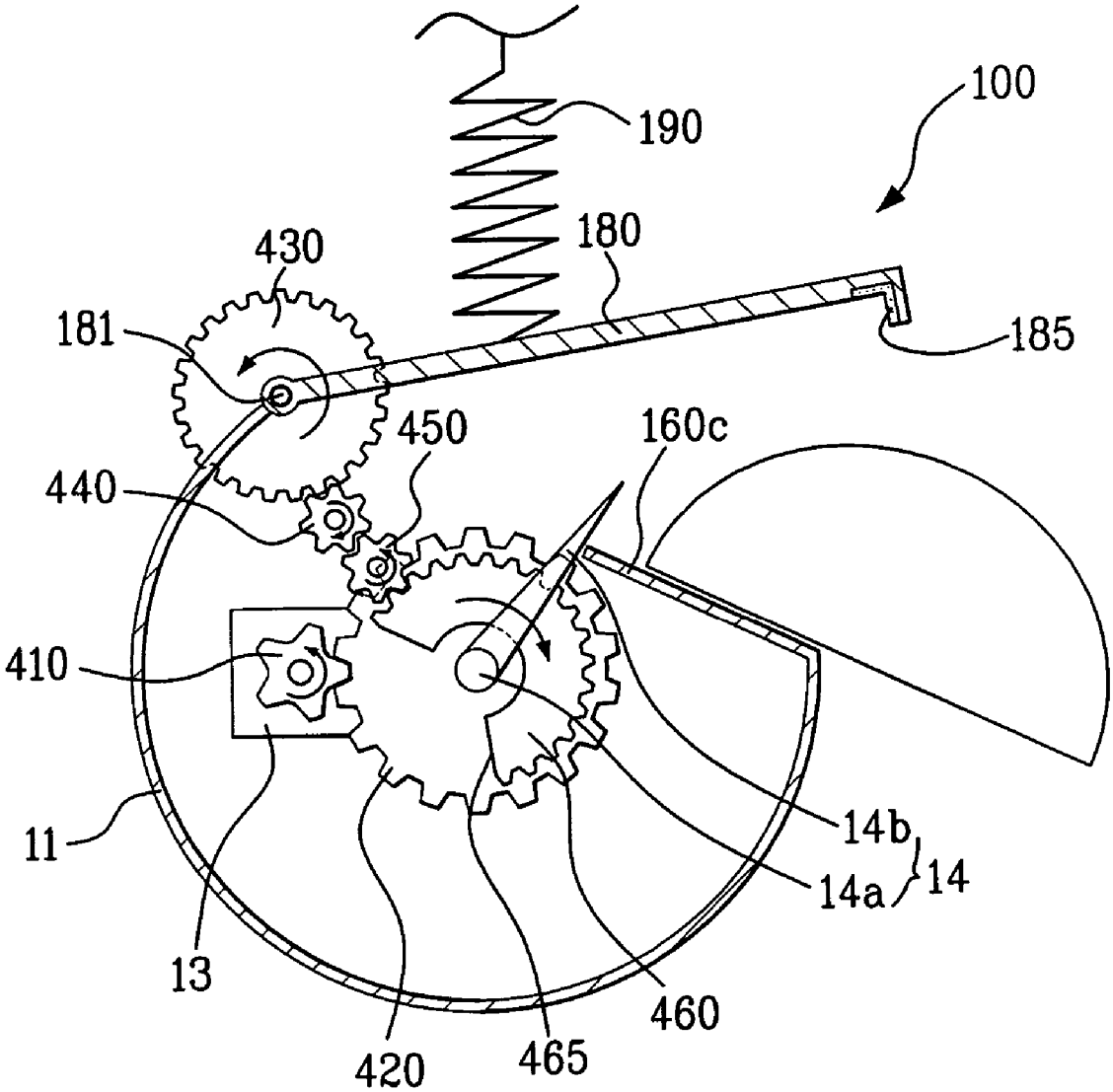
FIG. 14B is a cross-sectional view of an exemplary gear assembly and a spring provided for rotating a cover of the icemaker of FIG. 11 shown in state in which the cover is in an opened position.

FIG. 11 is an exploded, perspective view of a third embodiment of an icemaker in the ice supply system of FIG. 5. FIG. 12A is a cross-sectional view of an exemplary spring provided in the icemaker of FIG. 11 shown in a state in which a cover is in a closed position. FIG. 12B is cross-sectional view of an exemplary spring provided in the icemaker of FIG. 11 shown in a state in which a cover is in an opened position. FIG. 13A is a cross-sectional view of an exemplary gear assembly provided for rotating a cover of the icemaker of FIG. 11 in a state in which a cover is in a closed position. FIG. 13B is a cross-sectional view of an exemplary gear assembly provided for rotating a cover of the icemaker of FIG. 11 in a state in which a cover is in an open position. FIG. 14A is a cross-sectional view of an exemplary gear assembly and a spring provided for rotating a cover of the icemaker of FIG. 11 shown in state in which the cover is in a closed position. FIG. 14B is a cross-sectional view of an exemplary gear assembly and a spring provided for rotating a cover of the icemaker of FIG. 11 shown in state in which the cover is in an opened position.

In FIG. 11 to FIG. 14B, a third embodiment of the icemaker 100 in the ice supply system of FIG. 5 is illustrated. Hereinafter, the third embodiment will be described with reference to the drawings. As seen in FIG. 11, the overflow prevention device or device includes a cover 180 in contrast to the first and second embodiments. Of course, not only the cover 180, but also a dropper 160*c* is provided for preventing water from overflowing to the outside by a shaking motion of door 1 or the icemaker 100.

In the third embodiment, the dropper 160*c* is the same as that in the second and third embodiments and thus a repeated description will be omitted hereinafter. Referring to FIG. 11 to FIG. 12B, the cover 180 of this embodiment is coupled with a hinge at a top, rear portion of the ice tray 11 for opening or closing the open top of the ice tray 11. The cover 180 is formed, e.g., in a flat form, and the dropper 160*c* covers a side of the open top of the ice tray 11. Therefore, the cover 180 covers a remaining part of the dropper 160*c* at the upper part of the ice tray 11 as illustrated in FIG. 12A and FIG. 12B.

In the icemaker 100 according to the second embodiment, it is desirable that the cover 180 covers the upper part of the ice tray 11 by virtue of its own weight as illustrated in FIG. 12A and FIG. 12B. For this, a first end at a hinge axis 181 between both ends of the cover 180 is higher than a second end at an opposite side of the hinge side.

If the cover 180 is provided as described above, the cover 180 closes the ice tray 11 by its own weight when the fin 14*b* of the ejector 14 is in the first place. As illustrated in FIG. 12B, the cover 180 is pushed by the fin 14*b* an then opens the top of the ice tray 11 after the shaft 14*a* of the ejector rotates and is in contact with the bottom of the cover 180.

Referring to FIG. 12A and FIG. 12B, the cover 180 is provided to further cover a top surface of the dropper 160*c*. In this case, a sealing material 185 is provided at the second end at the opposite side of the hinge axis 181. If the sealing material 185 is provided, water is effectively prevented from leaking between the cover 180 and the dropper 160*c*.

Meanwhile, referring to FIG. 12A and FIG. 12B, a spring 190 is provided on the top surface of the cover 180 for improving adherence of the cover 180 and the top surface of the dropper 160*c*. A first end of the spring 190 is coupled with the top surface of the cover 180 and a second end of the spring is coupled with the door of the refrigerator. In this case, the spring is provided in a compressed form. Accordingly, the spring 190 always biases the cover 180 to adhere to the upper surface of the dropper 160*c*.

In the icemaker according to the third embodiment with the aforementioned structure, the shaft 100 is directly coupled with the motor 13 or via a gear assembly as illustrated in FIG. 12A and FIG. 12B. The gear assembly for transferring a rotational force of the motor 13 to the shaft 14*a* is described in greater detail hereinafter as a first gear assembly.

The first gear assembly includes a first gear 410 and a second gear 420 as illustrated in FIG. 12A and FIG. 12B. The first gear 410 is coupled with the motor 13 and the second gear 420 is engaged with the gear 410, and coupled with the shaft 14*a*. Accordingly, if the motor is operated and the first gear rotates, the second gear engaged with the first gear rotates together with the first gear when the shaft 14*a* rotates.

In the mean time, the shaft 14*a* slowly rotates and discharges the ice. Therefore, it is desirable that a number of teeth of the first gear 410 is less than the number of teeth of the second gear 420. In that case, although the motor 13 rotates at a high speed, the second gear 420 and the shaft 14*a* slowly rotate and the fin 14*b* discharges the ice with a large force.

When the icemaker 100 according to the third embodiment has an aforementioned structure, the shaft 14*a* and the fin 14*b* rotate together according to an operation of the motor 13 and discharges the ice to the top of the ice tray 11. In this case, the cover closes the ice tray 11 with its own weight and the force of the spring 190 before the ice pushed by the fin 14*b* pushes open the cover 180. Accordingly, water stored in the ice tray 11 is not leaked to the outside by shaking when opening and closing the door.

When the shaft 14*a* keeps rotating and the ice pushes the cover 180, the cover 180 rotates around the hinge axis 181 and opens the top of the ice tray 11. Accordingly, the ice is discharged through the open top of the ice tray 11 and the discharged ice slips along the top surface of the dropper 160*c* and is stored in the container 200. When the fin 14*b* further rotates clockwise, the cover 180 rotates clockwise by its own weight and the force of the spring 190, and covers the top of the ice tray 11. In the third embodiment, when the cover 180 covers the top surface of the dropper 160*c*, it is desirable that the slit is provided to the dropper 160*c*. When the slot is provided, the shaft 14*a* and the fin 14*b* rotate in a same direction. Accordingly, the structure is simple and manufacturing cost is reduced since it is not necessary to provide a motor which enables rotation in clockwise and counterclockwise directions and/or the sensor. The cover 180 is adhered to the top surface of the dropper 160*c* and water leaking through the slot as described in the second embodiment is not a concern.

An embodiment with a structure is illustrated in FIG. 11 to FIG. 12B, e.g., the structure wherein the cover 180 is pushed by the fin 14*b* or is pushed open by the ice pushed by the fin 14*b*. However, in the third embodiment, a structure wherein the cover 180 receives the power of the motor is opened. This structure will be briefly described hereinafter.

Referring to FIG. 13A and FIG. 13B, the second gear assembly is provided in the third embodiment for communicating the shaft 14*a* with the cover 180. In this case, the second assembly includes a third gear 430, a fourth gear 440, a fifth gear 450 and a sixth gear 460. The third gear 430 is provided to rotate together with the hinge axis 181 of the cover 180 as illustrated in FIG. 13A. The fourth gear 440 and the fifth gear 450 are engaged with the third gear 430 and the fourth gear 440, respectively. The sixth gear 460 is provided to rotate together with the shaft 14*a*.

An incised portion 465 is provided on an outer circumferential surface of the sixth gear 460 as illustrated in FIG. 13A and FIG. 13B. Accordingly, there is no tooth on a part of the outer circumferential surface of the sixth gear 460 having the incised portion 465. The fifth gear 450 is not engaged with the sixth gear 460 while the shaft 14*a* rotates at a predetermined angle due to the incised part 465. In this case, it is desirable that the incised part 465 is engaged by being pushed by the ejector 14 before coming into contact with the cover 180 until the fin 14*b* passes through the slot.

When the second gear assembly having the aforementioned structure is provided, the cover 180 opens by the operation of the motor 13. A brief description of this structure is provided hereinafter. When the motor 13 rotates in the state illustrated in FIG. 13A, the first gear 410 of the first assembly rotates, thereby rotating the second gear 420 and the shaft 14*a*. Accordingly, the fin 14*b* rotates clockwise at the first position. When the fin 14*b* rotates, the ice in the ice tray 11 separates from the inside of the ice tray 11 and is transferred out of the tray 11.

When the shaft 14*a* rotates, the sixth gear 460 rotates together with the shaft 14*a*. In a first stage of the rotating shaft 14*a*, the shaft 14*a* is not engaged with the fifth gear 450 and the sixth gear 460, i.e., due to the incised part 465. Accordingly, the third gear 430 and the hinge axis 181 are not rotated. When the shaft 14*a* keeps rotating, the ice draws near the cover 180 as it travels along the inner surface of the ice tray 11. In this case, the fifth gear 450 is engaged with the sixth gear 460 and the fourth gear 440 rotates together with the third gear 430. Accordingly, the hinge axis 181 rotates and the cover 180 opens the top of the ice tray 11. When the top of the ice tray 11 gradually opens, the ice is discharged through the top of the ice tray 11. The ice slips into the top surface of the dropper 160*c* and drops to the container 200.

When the fin 14*b* passes through the slot of the dropper 160*c*, the fifth gear 450 is not engaged with the sixth gear 460. At this time, the cover 180 is inversely rotated by its own weight to close the top of the ice tray 11. When the second gear assembly is provided, a spring 190 is further provided at the top of the cover 180 for connecting the cover 180 with the door as illustrated in FIG. 14A and FIG. 14B. In the case, where the fifth gear 450 is not engaged with the sixth gear 460 by the incised part 465, the cover 180 is inversely rotated by its own weight to close the top of the ice tray 11. Waterproofing of the tray 11 is improved by the spring 190 adhering the cover 180 to the dropper 160*c*.

When the second gear assembly is provided, the motor rotating in the first direction and the second direction is further provided. In this case, the fin 14*b* discharges the ice, rotates until it contacts the dropper 160*c* and inversely rotates until it reaches the first position. Accordingly, improved waterproofing is expected in this case since the aforementioned slot for rib 14*b* slot is no longer necessary.

The present invention having the structure described above has the following advantages. First, when the overflow prevention device including the panel is provided, water in the icemaker is prevented from overflowing to the rear of the icemaker by shaking generated when the door is opened or closed. Second, if the panel provided as the overflow prevention device has a curved surface, water sliding back and forth within the ice tray from side to side is lead to the inside thereof.

In addition, if the panel provided in the overflow prevention device is longitudinally provided, the ice tray and the panel are formed as a single body. If the dropper is provided, water is prevented from overflowing to the front of the ice tray when the door is opened or closed. If the cover is provided as the overflow prevention device, water is prevented from being flowed to the outside of the ice tray because the cover covers the open top of the ice tray when the door is opened or closed. Further, if the gear assembly is provided, the cover with a simple structure automatically opens or closes the ice tray.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An icemaker for a refrigerator comprising:

an ice tray receiving water and making ice;

an ejector provided adjacent to the ice tray and for discharging the ice in the ice tray; and a dropper covering a part of an upper part of the ice tray, the dropper dropping the ice discharged thereon by the ejector to below the ice tray, wherein the dropper has no gap through which the ejector passes so that water in the ice tray is prevented from overflowing through the dropper.

2. The icemaker according to claim 1, wherein the dropper comprises a top plate having an inclined upper surface, and wherein a side of the dropper adjacent to a central axis of the ejector is higher than an opposite side of the dropper.

3. The icemaker according to claim 1, wherein a side of the dropper adjacent to a central axis of the ejector comprises a convex surface.

4. The icemaker according to claim 1, wherein the dropper comprises a top plate with at least one groove provided on an upper surface of the top plate for directing ice discharged from the ice tray and dropped on an upper surface of the top plate to below the ice tray.

5. The icemaker according to claim 1, wherein the dropper is provided at a location offset from a central axis of the ice tray to a top portion of the dropper by a predetermined distance.

6. The icemaker according to claim 1, further comprising a sensor provided at a side of the dropper for sensing a rotation angle of the ejector when the ejector is in contact with the sensor.

7. The icemaker according to claim 6, wherein the side of the dropper at which the sensor is provided is adjacent to a central axis of the ejector.

8. The icemaker according to claim 6, further comprising a rotating mechanism for rotating, the ejector in a first direction from an initial position until the ejector contacts the sensor at a contact position, and for rotating the ejector in a reverse direction from the contact position until the ejector reaches the initial position.

9. The icemaker according to claim 6, further comprising a rotating mechanism for selectively rotating the ejector in a forward direction or in a reverse direction.

10. The icemaker according to claim 1, wherein the dropper is adapted to be separable from the ice tray.

11. The icemaker according to claim 10, wherein the dropper and the ice tray are adapted to be coupled with each other by fitting.

12. The icemaker according to claim 10, further comprising a seal provided between the dropper and the ice tray for improving adherence and waterproof between the dropper and the ice tray.

13. The icemaker according to claim 1, wherein the dropper comprises a shield extending downward from a side of the dropper adjacent to the ejector for leading water slopping in the ice tray to an inside of the ice tray.

14. The icemaker according to claim 1, further comprising a panel extended upward from the ice tray and located opposite the dropper for preventing water filled in the ice tray from overflowing out of the ice tray.

15. A refrigerator having an icemaker, comprising:

a chamber;

an ice tray for receiving water and making ice using a chill of the chamber;

an ejector provided adjacent to the ice tray and for discharging the ice in the ice tray;

a container for receiving and storing the ice discharged from the ice tray; and a dropper covering a part of an upper part of the ice tray, the dropper directing the ice discharged thereon by the ejector to the container, wherein the dropper has no gap through which the ejector passes so that water in the ice tray is prevented from overflowing through the dropper.

16. The refrigerator according to claim 15, wherein the dropper comprises a top plate having at least one groove provided on an upper surface of the top plate for directing ice discharged from the ice tray and dropped on an upper surface of the top plate to below the ice tray.

17. The refrigerator according to claim 15, further comprising a sensor provided at a side of the dropper for sensing a rotation angle of the ejector when the ejector is in contact with the sensor.

18. The refrigerator according to claim 15, wherein the dropper is adapted to be separable from the ice tray, the refrigerator further comprising a seal provided between the dropper and the ice tray for improving adherence and waterproof characteristics between the dropper and the ice tray.

19. The refrigerator according to claim 15, wherein the dropper comprises a shield extending downward from a side of the dropper adjacent to the ejector for leading water slopping in the ice tray to an inside of the ice tray.

20. A refrigerator comprising:

a chamber;

an icemaker provided within or next to a door of the refrigerator, the icemaker including:

an ice tray for receiving water and making ice using a chill of the chamber;

an ejector provided adjacent to the ice tray for discharging the ice in the ice tray;

a container for receiving and storing the ice discharged from the ice tray; and a dropper covering a part of an upper part of the ice tray for directing the ice discharged thereon by the ejector to the container, wherein the dropper has no gap through which the ejector passes so that water in the ice tray is prevented from overflowing through the dropper;

a dispenser provided at the door; and an ice chute provided to communicate the container and the dispenser at the door.

* * * * *